US011780703B2

(12) United States Patent
Adifon et al.

(10) Patent No.: US 11,780,703 B2
(45) **Date of Patent: *Oct. 10, 2023**

(54) SYSTEMS AND METHODS FOR OPERATION OF ELEVATORS AND OTHER DEVICES

(71) Applicants: Leandre Adifon, Mooresville, NC (US); Nino Mario Bianchi, Arenzano (IT); Marco Maria Ceriani, Sedriano (IT); Alessandro Ferraro, Padua (IT); Luciano Mozzato, Houston, TX (US)

(72) Inventors: Leandre Adifon, Mooresville, NC (US); Nino Mario Bianchi, Arenzano (IT); Marco Maria Ceriani, Sedriano (IT); Alessandro Ferraro, Padua (IT); Luciano Mozzato, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/537,455

(22) Filed: Nov. 29, 2021

(65) Prior Publication Data

US 2022/0081258 A1 Mar. 17, 2022

Related U.S. Application Data

(63) Continuation of application No. 17/376,154, filed on Jul. 15, 2021, which is a continuation-in-part of (Continued)

(51) Int. Cl.
*B66B 1/34* (2006.01)
*B66B 1/14* (2006.01)
(Continued)

(52) U.S. Cl.
CPC ..... *B66B 1/14* (2013.01); *B66B 1/2408* (2013.01); *B66B 1/28* (2013.01); *B66B 1/3461* (2013.01);
(Continued)

(58) Field of Classification Search
CPC ..... B66B 1/468; B66B 19/007; B66B 2201/4615; B66B 1/3461;
(Continued)

(56) References Cited

U.S. PATENT DOCUMENTS 6,161,655 A 12/2000 Lejon et al.
6,357,554 B1 3/2002 Valk et al.
(Continued)

FOREIGN PATENT DOCUMENTS

AU 2001242208 B2 2/2006
AU 2008320890 B2 9/2014
(Continued)

OTHER PUBLICATIONS

EESR pertaining to Application No. EP 21185921.0-1017, dated Dec. 16, 2021.
(Continued)

*Primary Examiner* — Marlon T Fletcher

(57) ABSTRACT

Embodiments of systems and methods for digital control of elevator and other access gateways are described herein. More specifically, embodiments comprise systems and methods for retrofitting or outfitting elevator systems with digital control systems that can be universally applied to virtually every manufacturer's elevator systems.

17 Claims, 15 Drawing Sheets

Related U.S. Application Data application No. 17/228,744, filed on Apr. 13, 2021, now Pat. No. 11,305,964, which is a continuation-in-part of application No. 17/063,729, filed on Oct. 6, 2020, now abandoned, said application No. 17/376,154 is a continuation-in-part of application No. 17/228,739, filed on Apr. 13, 2021, now Pat. No. 11,319,186, which is a continuation-in-part of application No. 17/063,729, filed on Oct. 6, 2020, now abandoned.

(60) Provisional application No. 63/052,386, filed on Jul. 15, 2020.

(51) Int. Cl.

| | |
|---|---|
| ***B66B 1/46*** | (2006.01) |
| ***B66B 1/52*** | (2006.01) |
| ***B66B 1/24*** | (2006.01) |
| ***B66B 1/28*** | (2006.01) |
| ***B66B 19/00*** | (2006.01) |

(52) U.S. Cl.

CPC ..... *B66B 1/3492* (2013.01); *B66B 1/468* (2013.01); *B66B 1/52* (2013.01); *B66B 19/007* (2013.01); *B66B 2201/463* (2013.01); *B66B 2201/4615* (2013.01); *B66B 2201/4623* (2013.01); *B66B 2201/4638* (2013.01); *B66B 2201/4653* (2013.01)

(58) Field of Classification Search

CPC ..... B66B 2201/4653; B66B 2201/463; B66B 2201/103; B66B 1/3492; B66B 7/06; B66B 2201/4607

See application file for complete search history.

(56) References Cited

U.S. PATENT DOCUMENTS

| | | | |
|---|---|---|---|
| 6,525,645 | B2 | 2/2003 | King et al. |
| 6,549,768 | B1 | 4/2003 | Fraccaroli |
| 6,772,862 | B2 | 8/2004 | Friedli |
| 6,868,945 | B2 | 3/2005 | Schuster et al. |
| 6,892,861 | B2 | 5/2005 | Friedli |
| 6,935,465 | B2 | 8/2005 | Friedli |
| 6,986,408 | B2 | 1/2006 | Takeuchi |
| 7,021,428 | B2 | 4/2006 | Han et al. |
| 7,215,238 | B2 | 5/2007 | Buck et al. |
| 7,319,966 | B2 | 1/2008 | Friedli et al. |
| 7,581,622 | B2 | 9/2009 | Amano |
| 7,620,817 | B2 | 11/2009 | Friedli et al. |
| 7,717,238 | B2 | 5/2010 | Hamaji et al. |
| 7,823,700 | B2 | 11/2010 | Boss et al. |
| 7,918,318 | B2 | 4/2011 | Friedli et al. |
| 7,936,249 | B2 | 5/2011 | Friedli |
| 7,996,015 | B2 | 8/2011 | Bloebaum |
| 8,028,806 | B2 | 10/2011 | Stanley et al. |
| 8,556,042 | B2 | 10/2013 | Gerstenkorn et al. |
| 8,669,939 | B2 | 3/2014 | Underkoffler et al. |
| 8,681,098 | B2 | 3/2014 | Underkoffler et al. |
| 8,684,142 | B2 | 4/2014 | Finschi |
| 8,723,795 | B2 | 5/2014 | Underkoffler et al. |
| 8,744,754 | B2 | 6/2014 | Kappeler et al. |
| 8,827,043 | B2 | 9/2014 | Kostka et al. |
| 8,831,640 | B2 | 9/2014 | Trinchero et al. |
| 8,833,525 | B2 | 9/2014 | Gerstenkorn et al. |
| 9,202,322 | B2 | 12/2015 | Kappeler et al. |
| 9,323,232 | B2 | 4/2016 | Blom et al. |
| 9,469,502 | B2 | 10/2016 | Parkkinen et al. |
| 9,481,548 | B2 | 11/2016 | Siddiqui et al. |
| 9,561,931 | B2 | 2/2017 | Kauppinen et al. |
| 9,580,272 | B2 | 2/2017 | Kappeler et al. |
| 9,589,398 | B2 | 3/2017 | Kappeler et al. |
| 9,632,671 | B2 | 4/2017 | Albright |
| 9,796,093 | B2 | 10/2017 | Mascorro Medina et al. |
| 9,801,053 | B1 | 10/2017 | Ziraknejad |
| 9,823,747 | B2 | 11/2017 | Underkoffler et al. |
| 9,988,237 | B1 | 6/2018 | Arguedas et al. |
| 9,988,238 | B2 | 6/2018 | Simcik et al. |
| 10,043,325 | B2 | 8/2018 | Friedli |
| 10,074,017 | B2 | 9/2018 | Jia et al. |
| 10,087,046 | B2 | 10/2018 | Armistead |
| 10,095,315 | B2 | 10/2018 | Amores-Llopis et al. |
| 10,112,799 | B2 | 10/2018 | Friedli |
| 10,118,797 | B2 | 11/2018 | Keser |
| 10,127,492 | B1 | 11/2018 | Chitiveli et al. |
| 10,163,285 | B2 | 12/2018 | Schoenfelder et al. |
| 10,182,487 | B2 | 1/2019 | Mohan et al. |
| 10,241,486 | B2 | 3/2019 | Finn et al. |
| 10,259,681 | B2 | 4/2019 | Simcik et al. |
| 10,275,968 | B2 | 4/2019 | Troesch et al. |
| 10,294,069 | B2 | 5/2019 | King et al. |
| 10,303,744 | B2 | 5/2019 | Muncy et al. |
| 10,358,318 | B2 | 7/2019 | Barajas Gonzalez et al. |
| 10,360,364 | B2 | 7/2019 | Robinson et al. |
| 10,486,941 | B2 | 11/2019 | Finschi et al. |
| 10,513,416 | B2 | 12/2019 | Fang et al. |
| 10,521,992 | B2 | 12/2019 | Troesch et al. |
| 10,532,909 | B2 | 1/2020 | Richmond et al. |
| 10,934,132 | B2 | 3/2021 | Troesch et al. |
| 2001/0002635 | A1 | 6/2001 | Yamakawa |
| 2003/0051947 | A1 | 3/2003 | Friedli |
| 2003/0116384 | A1* | 6/2003 | Friedli ..... B66B 1/18 187/247 |
| 2007/0186183 | A1 | 8/2007 | Hudson, Jr. |
| 2007/0197261 | A1 | 8/2007 | Humbel |
| 2009/0022131 | A1 | 1/2009 | Rusanen et al. |
| 2011/0308891 | A1* | 12/2011 | Friedli ..... B66B 1/3446 187/247 |
| 2012/0144193 | A1 | 6/2012 | Le Saint et al. |
| 2014/0339023 | A1 | 11/2014 | Friedli |
| 2015/0360912 | A1 | 12/2015 | Kattainen et al. |
| 2016/0031675 | A1 | 2/2016 | Silvennoinen et al. |
| 2016/0090270 | A1 | 3/2016 | Wang |
| 2016/0103500 | A1 | 4/2016 | Hussey et al. |
| 2016/0122157 | A1 | 5/2016 | Keser |
| 2016/0212194 | A1 | 7/2016 | Palin et al. |
| 2016/0221791 | A1 | 8/2016 | Berryhill |
| 2016/0236903 | A1 | 8/2016 | Blom et al. |
| 2016/0289042 | A1 | 10/2016 | Fang et al. |
| 2016/0289043 | A1 | 10/2016 | Fang et al. |
| 2016/0289044 | A1 | 10/2016 | Hsu et al. |
| 2016/0291558 | A1 | 10/2016 | Finn et al. |
| 2016/0311646 | A1 | 10/2016 | Bryant et al. |
| 2017/0144859 | A1 | 5/2017 | Scoville et al. |
| 2017/0234562 | A1 | 8/2017 | Ribbich et al. |
| 2017/0372600 | A1 | 12/2017 | Palin et al. |
| 2018/0074466 | A1 | 3/2018 | Witczak et al. |
| 2018/0132298 | A1 | 5/2018 | Birnam et al. |
| 2018/0282115 | A1 | 10/2018 | Baldi et al. |
| 2018/0362296 | A1 | 12/2018 | Friedli et al. |
| 2019/0098898 | A1 | 4/2019 | Olson et al. |
| 2019/0152741 | A1 | 5/2019 | Wedzikowski et al. |
| 2019/0248013 | A1 | 8/2019 | Deyle et al. |
| 2019/0248014 | A1 | 8/2019 | Deyle et al. |
| 2019/0248015 | A1 | 8/2019 | Florencio et al. |
| 2019/0248016 | A1 | 8/2019 | Deyle et al. |
| 2020/0042307 | A1 | 2/2020 | Grondine et al. |
| 2020/0048045 | A1 | 2/2020 | Xiong et al. |
| 2020/0061839 | A1 | 2/2020 | Deyle et al. |
| 2020/0355523 | A1 | 11/2020 | Jonsson et al. |
| 2020/0377340 | A1* | 12/2020 | Schnitzer ..... B66B 19/007 |
| 2022/0017327 | A1* | 1/2022 | Adifon ..... B66B 1/3461 |
| 2022/0048732 | A1* | 2/2022 | Adifon ..... B66B 1/468 |
| 2022/0048734 | A1* | 2/2022 | Adifon ..... B66B 1/2408 |

FOREIGN PATENT DOCUMENTS

| | | | | |
|---|---|---|---|---|
| CN | 101910042 | A * | 12/2010 | ..... B66B 1/468 |
| CN | 101632108 | B | 7/2011 | |
| CN | 102149622 | A * | 8/2011 | ..... B66B 1/2458 |
| CN | 101385382 | B | 2/2012 | |
| CN | 106144797 | B | 11/2016 | |

(56) References Cited

FOREIGN PATENT DOCUMENTS

| | | | | | |
|---|---|---|---|---|---|
| CN | 106465112 | A | | 2/2017 | |
| CN | 206193749 | U | | 5/2017 | |
| CN | 106951176 | A | | 7/2017 | |
| CN | 108861908 | A | | 11/2018 | |
| CN | 105203100 | B | | 12/2018 | |
| CN | 109789986 | A | | 5/2019 | |
| CN | 109923055 | A | | 6/2019 | |
| CN | 106144796 | B | | 1/2020 | |
| DE | 102015226354 | A1 | | 6/2017 | |
| EP | 2730530 | A1 | | 5/2014 | |
| EP | 3075696 | A1 | | 10/2016 | |
| EP | 3184476 | A1 | | 6/2017 | |
| EP | 3098191 | B1 | | 2/2018 | |
| EP | 3285160 | A1 | | 2/2018 | |
| EP | 3075693 | B1 | | 9/2018 | |
| EP | 3075694 | B1 | | 12/2018 | |
| EP | 3075695 | B1 | | 12/2018 | |
| EP | 2534929 | B1 | | 3/2019 | |
| EP | 3148915 | B1 | | 8/2019 | |
| EP | 3939924 | A1 | * | 1/2022 | ..... B66B 1/14 |
| ES | 2301599 | T3 | * | 7/2008 | ..... B66B 1/18 |
| FI | 115521 | B | | 5/2005 | |
| FI | 20060131 | A0 | | 2/2006 | |
| FI | 117091 | B | | 6/2006 | |
| FI | 121957 | B | * | 6/2011 | ..... B66B 1/46 |
| FI | 122260 | B | | 11/2011 | |
| FI | 123870 | B | | 11/2013 | |
| FI | 124267 | B | | 5/2014 | |
| FI | 2124267 | B | | 5/2014 | |
| FI | 20135538 | A | | 5/2014 | |
| GB | 2563891 | A | | 1/2019 | |
| JP | 3375643 | B2 | | 2/2003 | |
| JP | 4172573 | B2 | | 10/2008 | |
| JP | 4773655 | B2 | | 9/2011 | |
| JP | 2011525283 | A | | 9/2011 | |
| JP | 5237832 | B2 | | 7/2013 | |
| JP | 5495871 | B2 | | 5/2014 | |
| JP | 2016502484 | A | | 12/2017 | |
| JP | 2018076168 | A | | 5/2018 | |
| JP | 2019520281 | A | | 7/2019 | |
| JP | 2019135184 | A | | 8/2019 | |
| JP | 6645206 | B2 | | 2/2020 | |
| JP | 2018512076 | A | | 2/2020 | |
| KR | 100991477 | B1 | | 11/2010 | |
| KR | 1020110012702 | A | | 2/2011 | |
| KR | 101923401 | B1 | | 11/2018 | |
| MX | PA05009996 | A | | 11/2005 | |
| SG | 2013082250 | A | | 6/2014 | |
| WO | WO-0102279 | A1 | * | 1/2001 | ..... B66B 1/2408 |
| WO | 2001098189 | A1 | | 5/2005 | |
| WO | WO-2012130641 | A1 | * | 10/2012 | ..... B66B 1/34 |
| WO | 2017144384 | A1 | | 8/2017 | |
| WO | 2017175019 | A1 | | 10/2017 | |
| WO | 2017220362 | A1 | | 12/2017 | |
| WO | 2018067911 | A1 | | 4/2018 | |
| WO | 2019136425 | A1 | | 7/2019 | |
| WO | 2019141468 | A1 | | 7/2019 | |
| WO | WO-2022013814 | A1 | * | 1/2022 | ..... B66B 1/14 |

OTHER PUBLICATIONS

PCT International Search Report and Opinion pertaining to PCT/IB2021/056407, dated Dec. 7, 2021.

International Search Report dated May 6, 2021; PCT/US2020/066679; Filing Date Dec. 22, 2020.

* cited by examiner

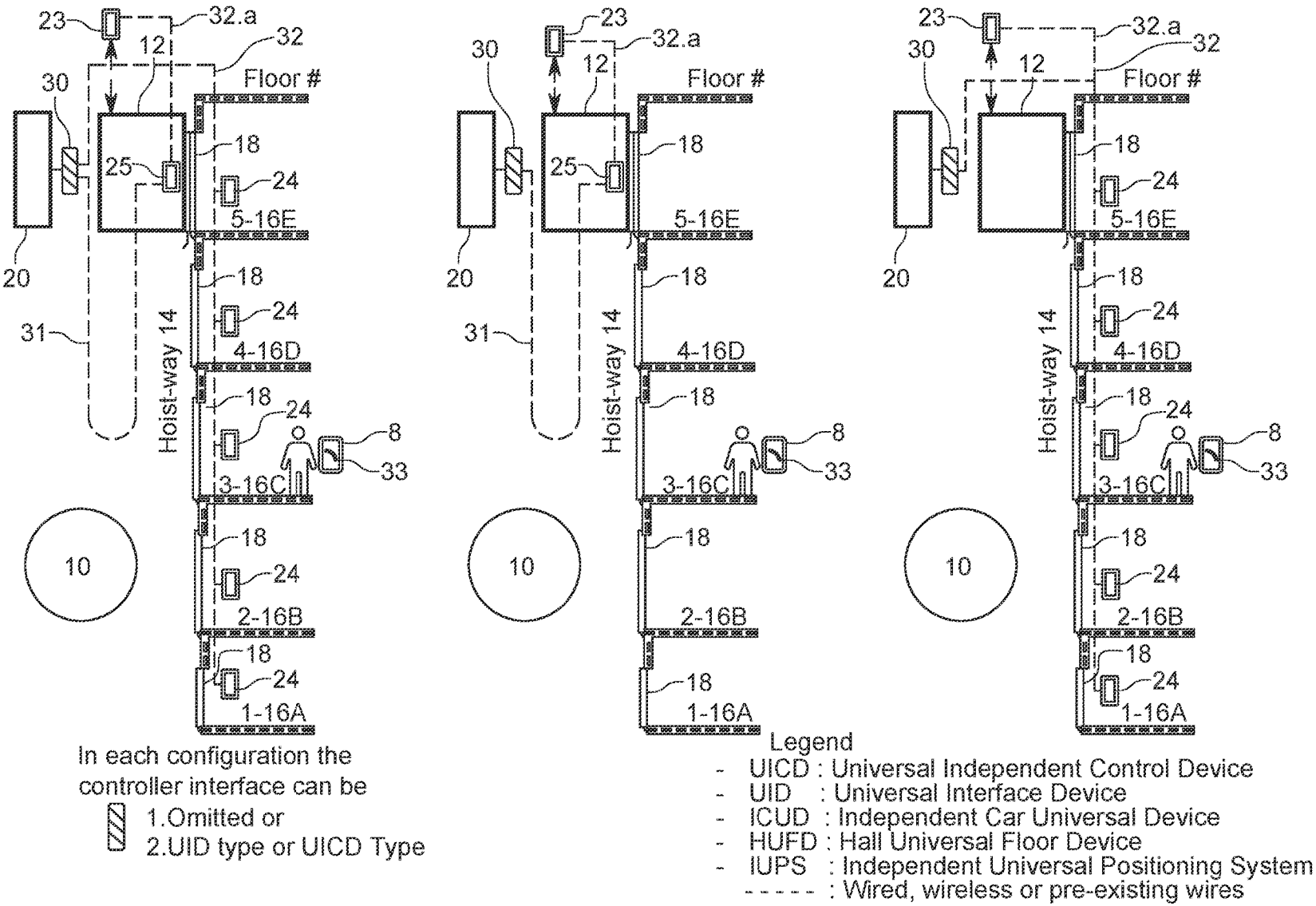
FIG. 1.a.1
FIG. 1.a.2
FIG. 1.a.3

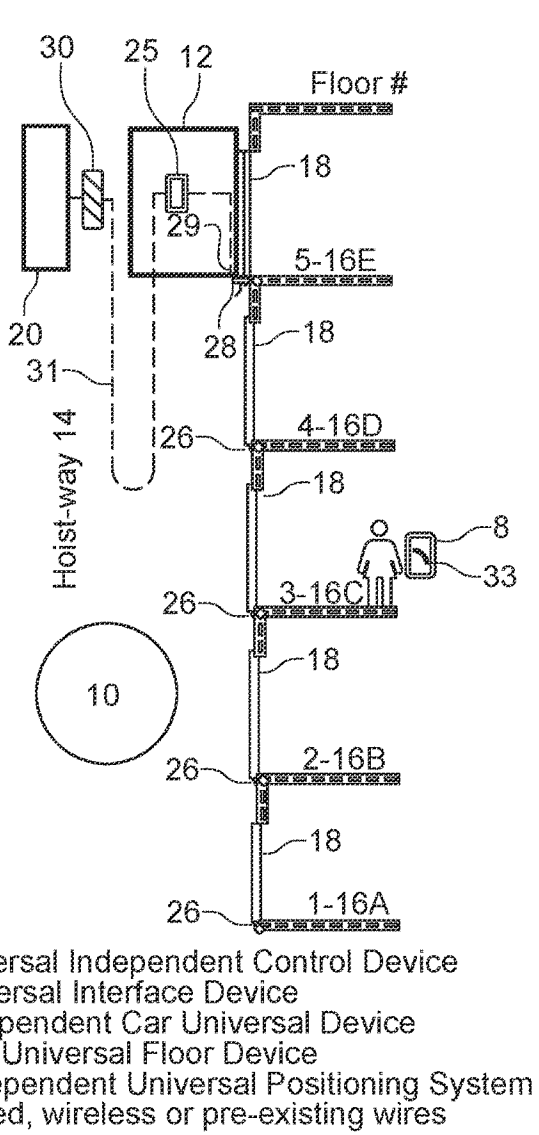
FIG. 1.b.3
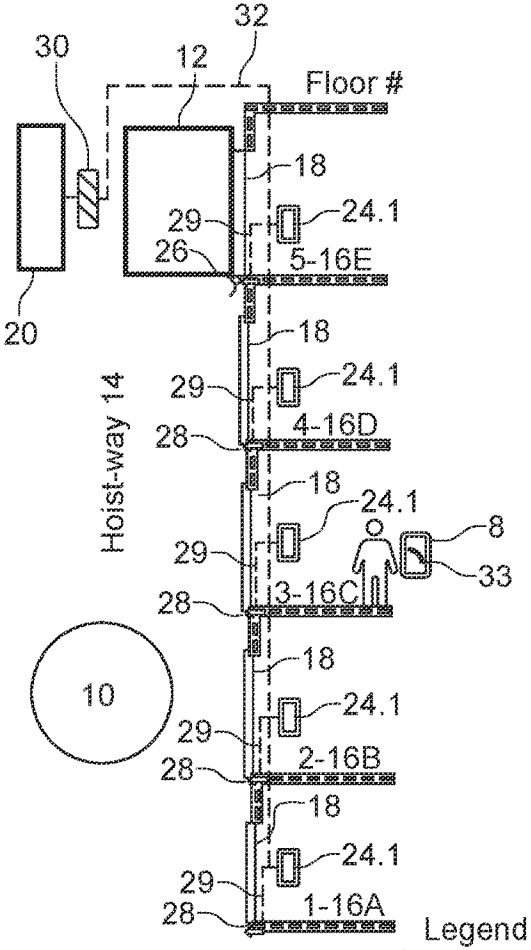
FIG. 1.b.2
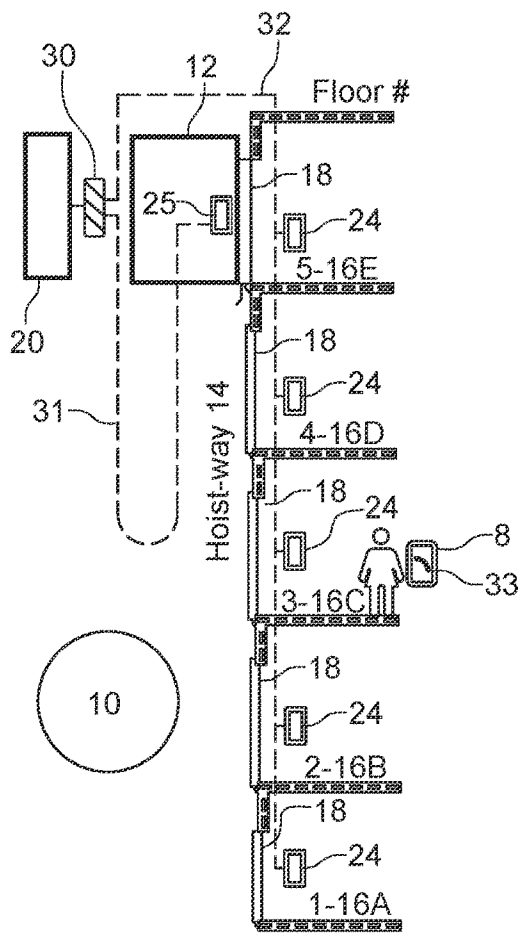
FIG. 1.b.1

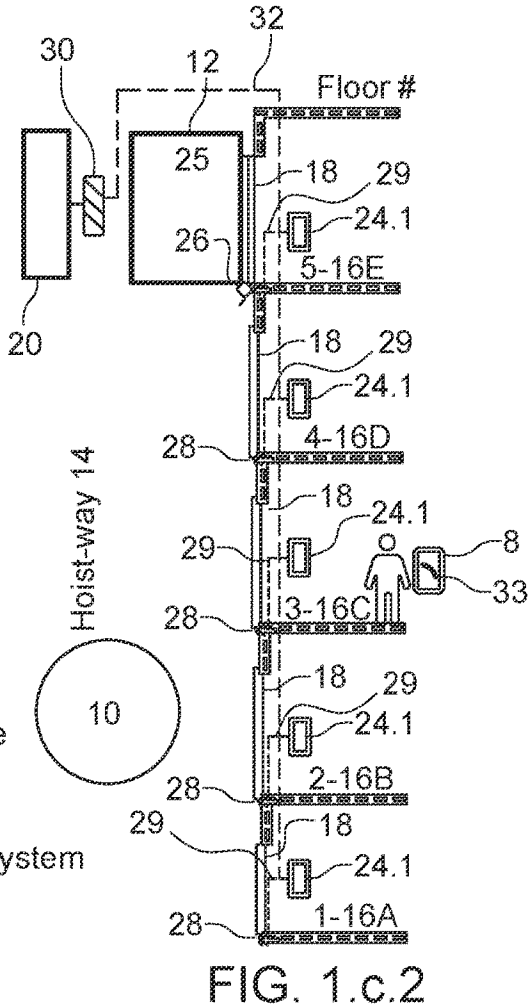
FIG. 1.c.2
Legend
- UICD : Universal Independent Control Device
- UID : Universal Interface Device
- ICUD : Independent Car Universal Device
- HUFD : Hall Universal Floor Device
- IUPS : Independent Universal Positioning System
- - - - - - : Wired, wireless or pre-existing wires
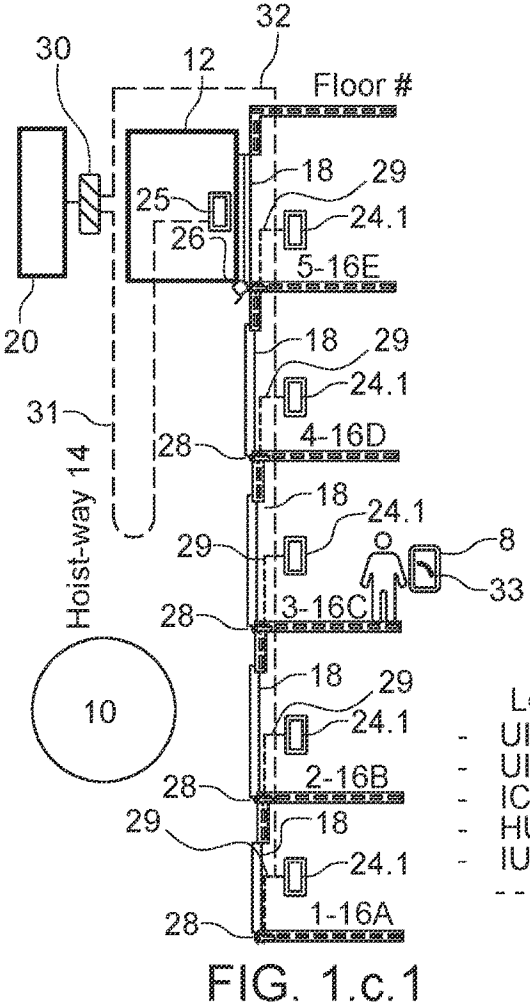
FIG. 1.c.1
In each configuration the controller interface can be 1.Omitted or

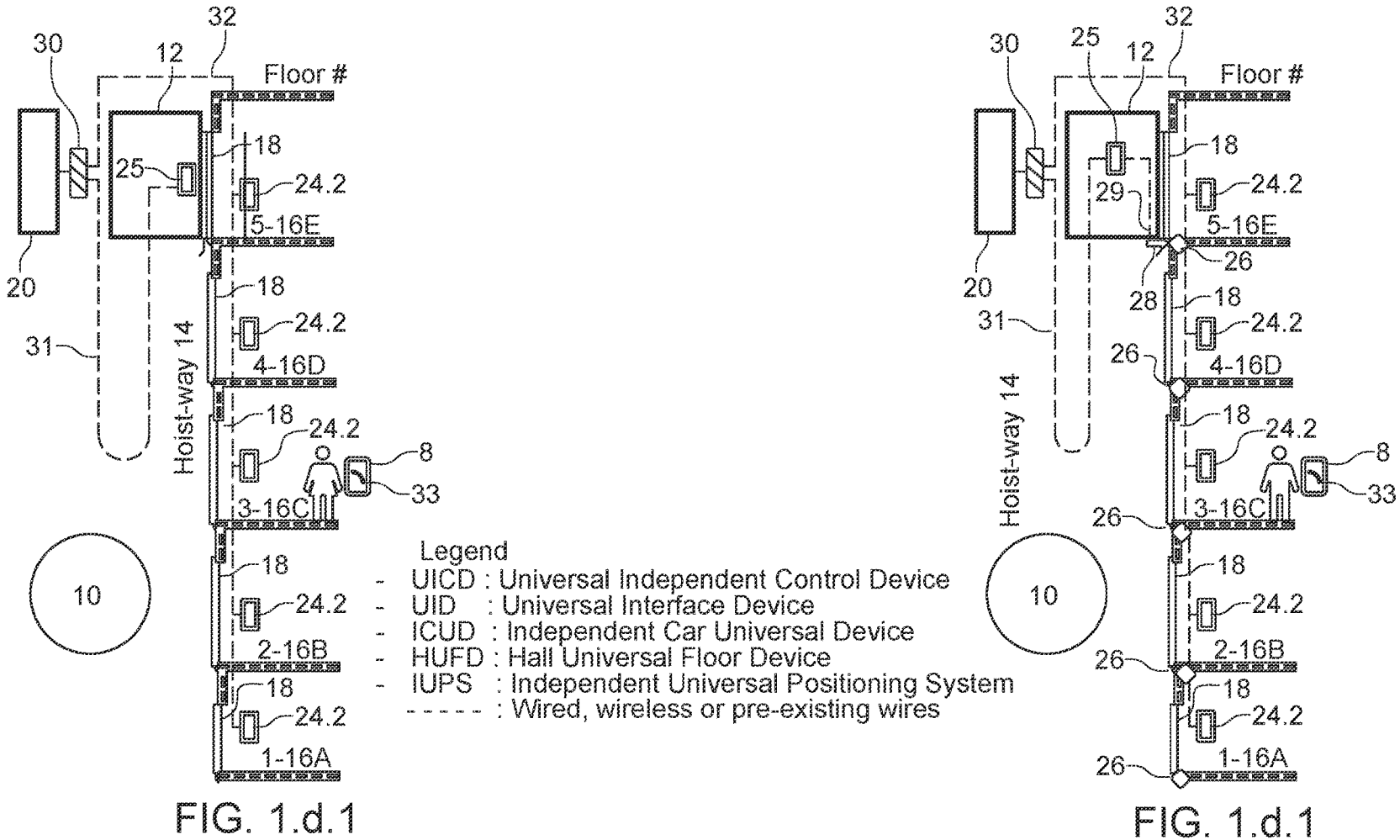
FIG. 1.d.1
FIG. 1.d.1
In each configuration the controller interface can be
1.Omitted or
2.UID type or UICD Type

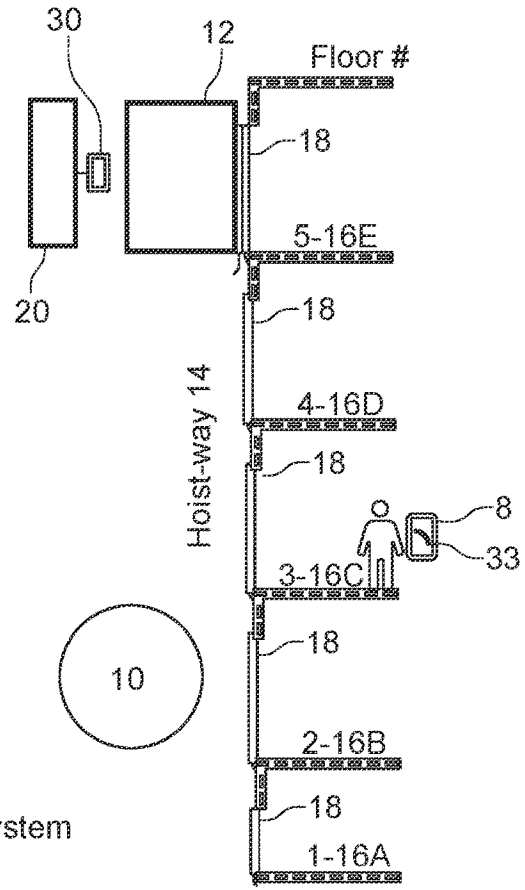
FIG. 1.e.2
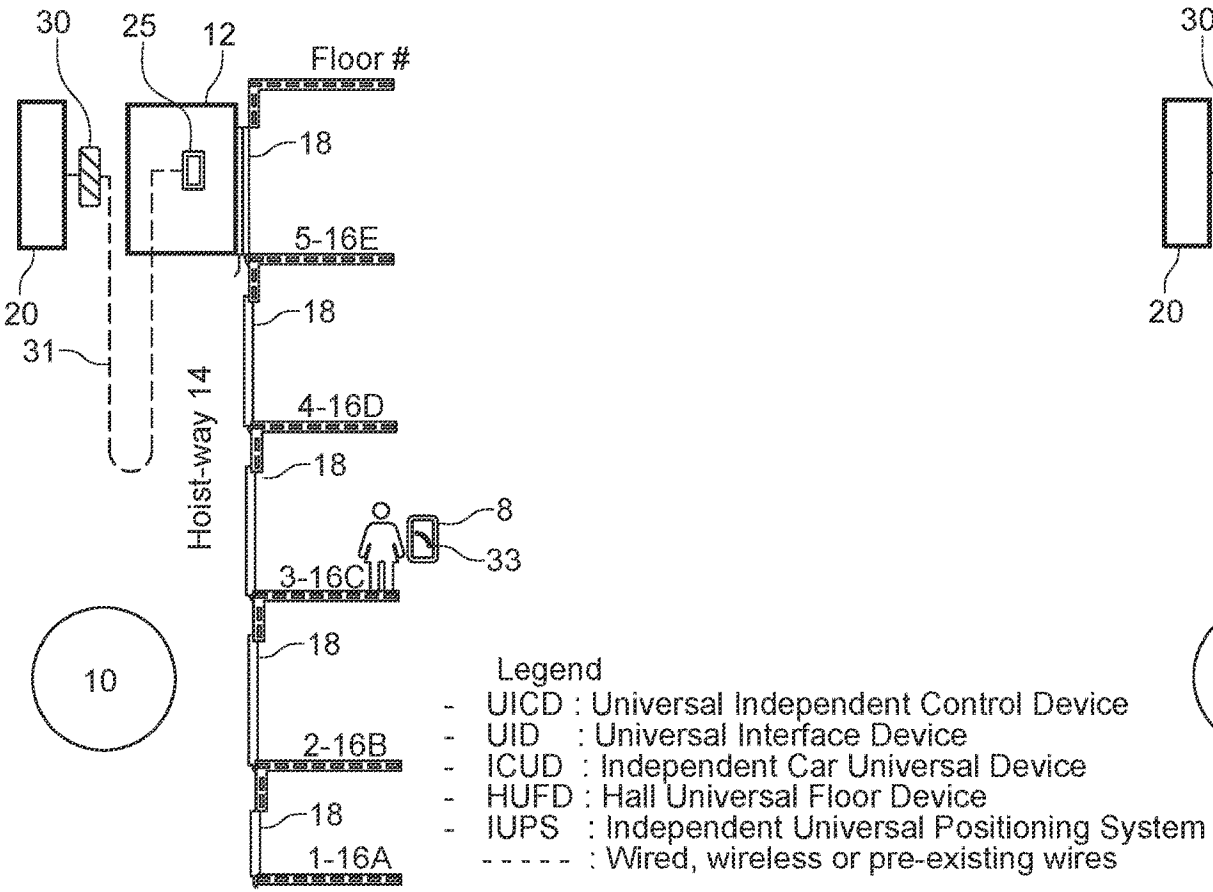
FIG. 1.e.1
In each configuration the controller interface can be
1.Omitted or
2.UID type or UICD Type Direction: Up Actual floor: 12

Departure floor: 15

Destination floor: 25

Time to floor destination: 10" (from floor 12th to 25th)

Total destination time: 1'25"

Notes: For Security Access Granted

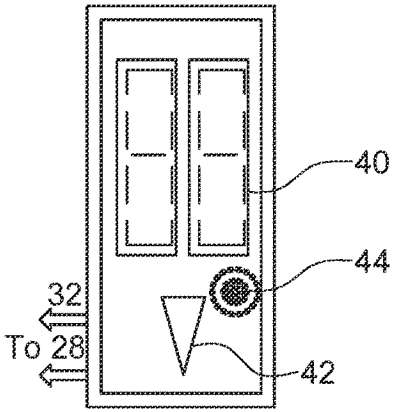
FIG. 4.c1
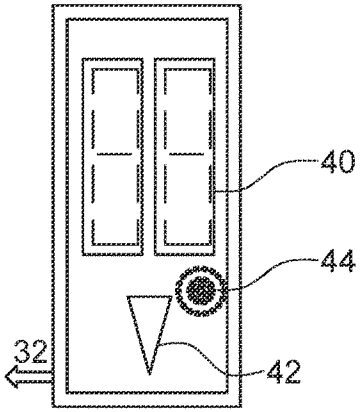
Top Floor
FIG. 4.c2
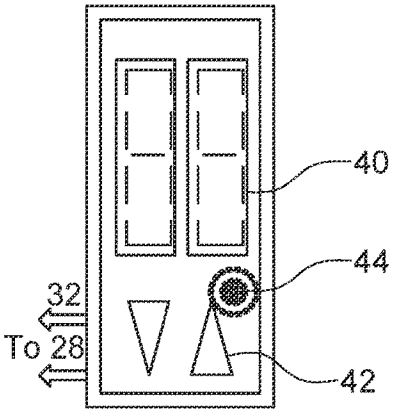
FIG. 4.b1
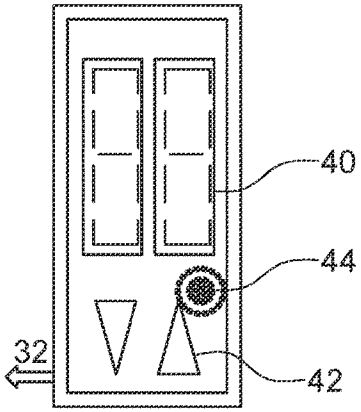
Intermediate Floor
FIG. 4.b2
FIG. 4
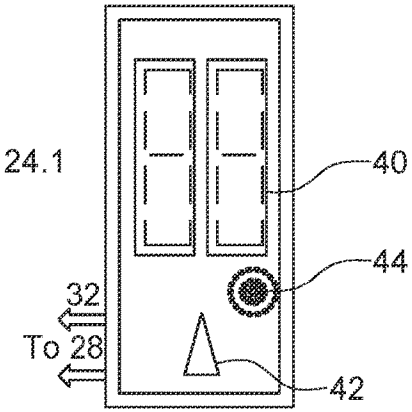
FIG. 4.a1
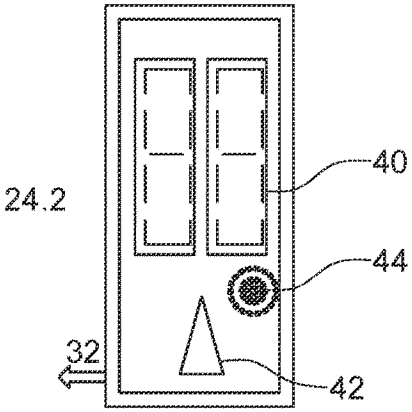
Bottom Floor
FIG. 4.a2

SYSTEMS AND METHODS FOR OPERATION OF ELEVATORS AND OTHER DEVICES

CLAIM OF PRIORITY TO EARLIER APPLICATION

This application is a Continuation of U.S. Non-Provisional patent application Ser. No. 17/376,154, filed on Jul. 15, 2021, and claims priority to and incorporates in its entirety each of: United States Provisional Patent Application 63/0523,386 filed on Jul. 15, 2020; U.S. Non-Provisional patent application Ser. No. 17/063,729 filed on Oct. 6, 2020; U.S. Non-Provisional patent application Ser. No. 17/228,739 filed on Apr. 13, 2021; U.S. Non-Provisional patent application Ser. No. 17/228,744 filed on Apr. 13, 2021; Patent Cooperation Treaty patent application Serial No. PCT/US20/66679 filed on Dec. 22, 2020; and U.S. Non-Provisional patent application Ser. No. 17/376,154 filed on Jul. 15, 2021.

FIELD OF THE INVENTION

The present invention relates to systems and methods for operation of elevators or other user access gateways.

BRIEF DESCRIPTION OF THE DRAWINGS

To facilitate further description of the embodiments, the following drawings and descriptions, which should not be considered limiting in any way, are provided. The drawings do not illustrate every embodiment of the present invention. With reference to the accompanying drawings, like elements are numbered alike.

FIGS. 1.*a*.1-1.*e*.2 illustrate several examples of universal digital control systems according to one or more varying embodiments.

FIGS. 4.*a*.1-4.*c*.2 illustrate several examples of universal floor devices according to one or more embodiments.

DETAILED DESCRIPTION

Figure 2:
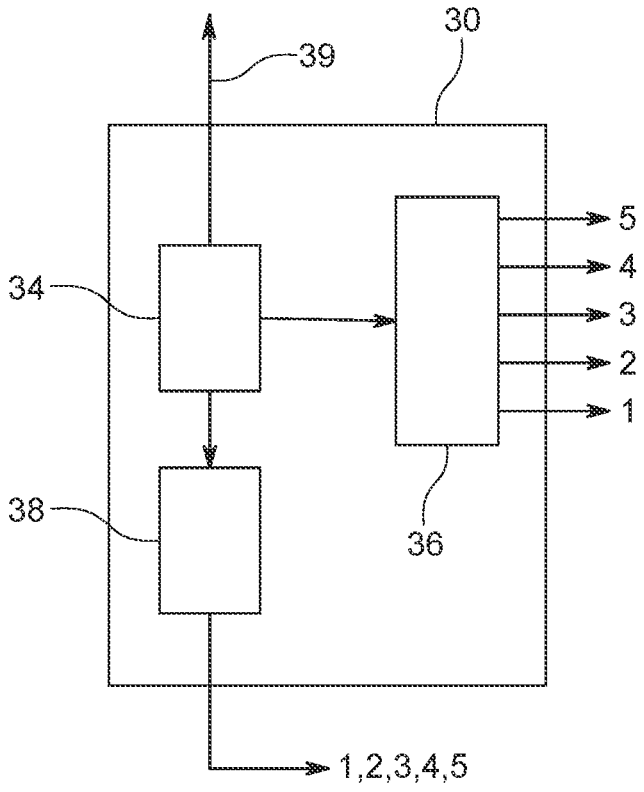
FIG. 2 illustrates an example of a universal interface device according to one or more embodiments.

The present invention addresses several needs relating to, as well as new and useful improvements in, elevator and other gateway access operations. Elevator systems are used throughout the world and may embody control systems ranging from very basic to highly sophisticated. Expanding digital controls and digital interfaces increasingly provide many advantages to elevator users as well as elevator owners (e.g., owners of buildings having one or more elevator systems). However, many limitations inherently exist in elevator control systems installed around the world—most of which include only very basic control systems. Some significant limitations are that many installed elevator systems are limited to the technical bounds of the original control systems of the elevator and/or limited by the high costs of upgrades to proprietary control systems of the original elevator control system manufacturer.

Accordingly, there is a need for universally applicable elevator control systems digital retrofits or upgrades that can be easily applied to a wide range of original equipment manufacturer (OEM) sourced elevator control systems and Non OEM sourced elevator control systems without entailing too high a cost or complexity in equipment, installation and operation while yet providing a robust platform for yet future enhancements and sophistication in the control systems. Further, there is a need for digital control packages and components for new build elevators according to certain embodiments of the present invention. Further, there is a need for an independent elevator system health monitoring and reporting system.

Aspects of certain embodiments of the present invention provide such a "universal" independent elevator digital control system that can be inexpensively supplied and easily installed on virtually all existing elevator systems without compromising the underlying mechanical and safety operations of the elevator system. Aspects of the present invention may also be applied to new elevator installations or build-outs as well as to other digital gateway control systems.

Additionally, aspects of certain embodiments of the present invention provide that the universal independent control system, once installed, can be configured to operate in conjunction with elevator users' mobile phones or other electronic devices such that the elevator user may, via the user's mobile phone (or other electronic device), call an elevator and select a destination floor and be conveyed by the elevator without having to physically touch any input components of the elevator (apart from actually entering and riding the elevator). In the same fashion, a user may, via mobile phone or other electronic device, communicate other commands or instructions to the elevator system such as "close door", "hold door open", "stop elevator travel", signal an "alarm", and/or other typical elevator commands or instructions. Further, data, messages, instructions and other information from the universal control system can be communicated or supplied to the user's mobile phone or other electronic device where it may be displayed, prompt user input, and/or issue audio signals or speech to facilitate the use of the present invention by people with disabilities, and/or otherwise utilized on the mobile phone or other electronic device. More discussion of the touchless control aspects of the universal control system will be presented below.

Some or all of the components of the system, can, in certain embodiments employ smart technology such as to learn and automatically select user preferences (such as floor destination) when the user's mobile phone is detected by the system. Various embodiments of the present system, can alternatively include or omit various components, including as shown in some combinations of components as shown herein.

Aspects of the present invention may comprise an independent system for upgrading an existing elevator system in a structure, wherein the existing elevator system comprises: a plurality of first floor devices with separate first floor devices positioned respectively on individual floors of the structure and each first floor device configured to receive elevator passenger call inputs; a first elevator car control input panel at least one first elevator vertical position sensing system; an elevator controller which receives signals corresponding to passenger call inputs from the first floor devices; which receives signals corresponding to passenger floor destination inputs from the car control input panel; and which controls travel and safety operations of the elevator; and a first communication system providing communications between the plurality of first floor devices and the elevator controller; and wherein the independent system is configured to receive signals corresponding to passenger elevator call inputs and passenger floor designation inputs and comprising: a plurality of second floor devices with separate ones of the second floor devices positioned respectively on individual floors of the structure and configured to receive elevator passenger call inputs; an independent control component (in some embodiments termed a control device) in functional communication with the elevator controller, the second floor devices and an elevator vertical position sensing system and configured to: process received signals corresponding to elevator passenger call inputs, passenger floor destination inputs, and elevator vertical position data and generate an elevator car travel itinerary based on the processed signals; and generate command signals for transmission to the elevator controller to cause the elevator controller to provide elevator car service conforming to the generated elevator car travel itinerary; and dispatch the generated command signals to be communicated to the elevator controller; and an independent interface component configured to groom dispatched command signals from the independent control component such that the groomed command signals mimic signals received by the elevator controller from the first floor devices and the car control input panel; and wherein the independent system is further configured such that the groomed dispatched command signals are communicated to the elevator controller. In some embodiments the control component (sometimes termed "control device") may comprise and/or consist of an Universal Independent Control Device (as described herein). In some embodiments the Universal Independent Control Device may comprise and/or consist of the control component (or control device).

Aspects of the present invention may further comprise an independent system wherein the elevator controller maintains direct control over travel and safety operations of the elevator car (including controls commonly referred to as "safety chain controls") but also directs the operations of the elevator car in response to the command signals delivered to the elevator controller from the independent control component. Aspects of the present invention may comprise an independent system wherein at least one of the second floor devices is configured to receive passenger service call requests from an elevator passenger mobile phone. Aspects of the present invention may further comprise an independent system further comprising a second elevator car device attached to the elevator car and configured to receive passenger floor destination inputs from an elevator passenger mobile phone. In some embodiments passenger floor destination inputs may be received by one or more second floor devices, including in some embodiments even before the passenger enters the elevator car.

Aspects of the present invention may further comprise a second communications system that provides functional signal communication between the independent control component, each of the second floor devices, the second elevator car device, and the independent interface component. In some embodiments a second communications system may provide functional signal communications between each of the second floor devices, the second elevator car device and the independent control component without utilizing the first communications system. Aspects of the present invention may comprise an independent system that further comprises a second elevator car vertical position sensing system in functional communication with the independent control component and wherein the independent control component processes data from the second elevator car vertical position sensing system in generating the elevator car travel itinerary. Further aspects may comprise wherein the second communications system provides functional signal communications between the second elevator car vertical position sensing system and the independent control component without utilizing the first communications system.

Aspects of the present invention may further comprise an independent system wherein least one second floor device comprises an independent control component. Aspects of the present invention may further comprise an independent system wherein the second elevator car device comprises an independent control component. Aspects of the present invention may further comprise an independent system wherein an independent control component is operatively connected to the second communications system and included in a device other than a second floor device or a second elevator car device.

Aspects of the present invention may comprise an independent system for upgrading an existing elevator system in a structure, wherein the existing elevator system comprises: an elevator car; a plurality of first floor devices, each of the first floor devices positioned on a separate floor of the structure and configured to receive elevator passenger call inputs; a first elevator car control input panel positioned in the elevator car; at least one first sensing system to sense elevator vertical position a first elevator controller which receives passenger call inputs from the first floor devices and passenger control inputs from the first elevator car control input panel and also controls travel and safety operations of the elevator, and a first communication system providing communications between the plurality of first floor devices, the first elevator car control input panel, the first sensing system, and the first elevator controller; the independent system comprising: a plurality of second floor devices, each of the second floor devices positioned on a separate floor of the structure and each of the second floor devices configured to receive elevator passenger call inputs; a second communication system configured to provide signal communication between each of the second floor devices and the first elevator controller and to provide signal communication with an elevator vertical position sensor system which reports, or provides data regarding, the vertical position of the elevator; and wherein each of the second floor devices may be configured to receive passenger service requests and transmit the signals representing the received service requests to the first elevator controller by the second communication system. Further aspects of the independent system may comprise communications components configured to provide touchless data communications between at least one of the second floor devices and a portable electronic device controlled by the elevator passenger. In certain aspects of the independent system the portable electronic devices may comprise various mobile communication devices such as one or more mobile telephones.

In additional aspects the system may comprise an independent system having a second communications system configured to receive elevator vertical position data from the first elevator vertical position sensing system. In some aspects the system may comprise a second vertical positions sensor system and, also may comprise an independent system having a second communications system configured to provide signals communications between various components of the independent system and, in some instances, with components of the first elevator system. In additional aspects the system may comprise a second elevator car device attached to the elevator car and configured to receive passenger control inputs via a touchless system. In some aspects the system may be further configured to provide signals representing passenger control inputs received at the second elevator car device via a touchless system to the first elevator controller. In some aspects the signals representing passenger control inputs received at the second elevator car device via a touchless system may be transmitted from the elevator car to the first elevator controller at least in part via an electrically conductive wireline system extending from the elevator car in the structure hoistway to the first elevator controller. In further aspects the second communications system may comprise an electrically conductive wireline disposed in the elevator hoistway of the structure housing the elevator system and each of the second floor devices may be electrically connected to the conductive wireline disposed in the elevator hoistway.

In certain embodiments, aspects of the invention may comprise one or more of the above referenced embodiments, wherein signals representing passenger control inputs received at the second elevator car device via a touchless system are transmitted from the second elevator car device to the second communications system by way of a wireless communications system. Further, aspects may include wherein the second communications system comprises mutually communicating wireless data transmission/receiving components in each of the second floor devices. In some embodiments, the second communication system may comprise wireless communications between one or more components of the independent system. Additionally, aspects may include wherein the second elevator vertical position sensor system comprises a sensing system disposed in the elevator hoistway of the structure. In some embodiments, aspects may include wherein the second elevator vertical position sensor system comprises first and second cooperatively operating proximity sensor components, a first cooperatively operating proximity sensor component configured in each of the second floor devices and the second cooperatively operating proximity sensor disposed on the elevator car such that each second floor device accurately determines the vertical position of the second cooperatively operating proximity sensor when the elevator car is proximate the respective second floor device, and each floor device transmitting signals representing sensed elevator vertical position data on the second communications system.

In certain embodiments, aspects of the invention may comprise one or more of the above referenced embodiments, wherein at least one of the second floor devices is disposed on a main floor of the structure and comprises a smart electronic control component configured to: identify at least one elevator passenger mobile communication device such as a phone and identify a floor selection command provided from that passenger mobile phone to the independent system. Further, in some embodiments, the smart electronic control component(s) may store the identified floor selection in a database in association with the identity of the respective identified mobile communication device. In some embodiments, the mobile communication device may serve to "push" a previously selected floor destination to the independent system, as compared in some instances to a system wherein the smart system initiates identification of a previously selected floor destination from the smart system's own database. Further aspects may comprise wherein the smart electronic control component is further configured: to monitor the proximity of the at least one of the second floor devices in such a manner that when that passenger mobile phone is sensed in proximity to the at least one of the second floor devices in a second instance, the smart electronic control component: recalls the stored identified floor selection associated with that passenger mobile phone; causes the at least one of the second floor devices, via touchless communication, transmit the recalled identified floor location to the passenger mobile phone; and upon confirmation, via touchless communication from the passenger mobile phone, transmits the confirmed identified floor selection via the second communications system to the elevator controller to command the elevator car to travel to the confirmed identified floor.

In certain embodiments, aspects of the invention may comprise one or more of the above referenced embodiments, wherein at least one of the second floor devices is disposed on a main floor of the structure and comprises a smart electronic control component operatively connected to people recognition system such as a camera or hand scan system and configured to: process data received from the recognition system to identify an elevator passenger; in a first instance, identify a floor selection command provided from that passenger to the independent system; store data representing the identity of the elevator passenger in association with the floor selection command from that passenger; in a second instance recognize the proximity of the passenger to the camera system based at least in part on stored data representing the identity of the passenger; in response to identifying, in the second instance, the passenger, communicate via a touchless system messaging suggesting the associated stored floor selection; and cause that the second communication system signals the first elevator controller to convey the elevator car to the floor associated with the stored floor selection. In certain embodiments, aspects may comprise at least one of the second floor devices disposed on the main floor of the structure and which manages system control for all the second floor devices and the second communications system. Further, in some aspects at least one of the second floor devices disposed on the main floor of the structure is configured: to process at least a portion of the passenger service requests received at any of the second floor devices and send dispatch signals to the first elevator controller by way of the second communication system such that the first elevator controller dispatches the elevator to the floor corresponding to the second floor devices at which the passenger service request was received. Additionally, in some aspects at least one of the second floor devices disposed on the main floor of the structure is configured: to track and store operational data representing event logging of identities of passengers making service requests to the independent system; event logging of elevator car dispatch and travel at the direction of the first elevator controller; and event logging of maintenance services on the elevator system; to provide access to the operational data by management computing systems.

In certain embodiments, aspects of the invention may comprise one or more of the above referenced embodiments, wherein the at least one floor device disposed on the main floor comprises a control interface module that grooms passenger call input signals communicated from the at least one floor device to the first elevator controller to replicate or mimic passenger call inputs provided to the first elevator controller from the first floor devices. In some aspects, the independent system further comprises: a first communication subsystem between at least a plurality of components of the independent system; and a second communication subsystem communicating instructions from a second floor device disposed on the main floor of the structure to the elevator controller; and wherein the second communication subsystem communicates signals from elevator controller to the second floor device disposed on the main floor; and wherein the second floor device disposed on the main floor communicates signals representing the data of the signals received from the elevator controller over the first communication subsystem. In some aspects, the elevator controller may dictate travel and safety operations of the elevator notwithstanding the elevator controller receiving passenger call inputs or passenger control inputs from the independent system. In some aspects, a control interface device in functional communication with each of the second floor devices is configured to provide a separate signal to each of a plurality of signal processing and communication devices of the first elevator controller. In some aspects, the second elevator car device is in functional electronic signaling connection with the first elevator car device. In some aspects, the system may further comprise a temperature sensing device in scanning relation to the interior of the elevator car; the temperature sensing device in functional signaling connection with the second communication system, and a module of a component in functional signaling connection with the second communication system configured to sense body temperature of individuals entering the elevator car and signal an alert if a sensed body temperature exceeds a predetermined level. In some aspects, the control interface device is incorporated into at least one of the second plurality of floor devices. In some embodiments, one or more of the second plurality of floor devices are configured to receive passenger service requests and sensed floor location data from the second vertical position sensing unit and transmit the received service requests to the elevator controller. In some aspects, the control interface device may be incorporated into the second independent car device which is configured to receive passenger service requests and sensed vertical position data from the second vertical position sensing system (or information from the first vertical position sensor system) and transmit the received service requests to the elevator controller or to the first car device. In some aspects, the transmission of data from the second plurality of floor devices to the control interface device is independent from the first communication system. In some aspects of the invention the first and/or the second positioning sensor or sensor system may be connected in signal communications to one or more of the floor devices. In some other aspects the first and/or the second vertical position sensor system may be connected in signal communications with the independent car device. In some other aspects the second vertical position sensing system may be realized through communication between the independent car device and one or more of the independent floor devices and their relative position or by using the information from the first vertical position sensing system.

In some aspects, a method is provided of upgrading a first existing elevator system having components such as a plurality of first floor devices, an elevator control device and a first communications system providing transmission of signals between the plurality of first floor devices and the elevator control device, the method comprising: installing a second system at the existing elevator system, the second system comprising a plurality of second floor devices and a second communication system providing transmission of signals between the plurality of second floor devices and an elevator vertical position sensor system; connecting the second system to the first system such that the first system maintains direct control over travel and safety operations of the elevator car and the second system inputs additional elevator user system calls/directions to the first system; and such that the first system directs elevator travel under the commands from the second system. In some aspects, the second system may collect control information from control mechanisms of the first system and communicates at least a portion of the collected information to a user of the second system. In some aspects, the second system may process information received from the control mechanisms and makes decisions therefrom and communicate information reflecting such decisions to an elevator passenger via the second system.

Some aspects of the present invention comprise a method of upgrading an existing elevator system already comprising floor devices, an elevator controller, location sensor system, car devices and first communication system, the method comprising: positioning at least one second floor device at one floor of the elevator installation; installing a second vertical position sensing system; installing a second car device; establishing a second communications system between the at least one second floor device, the second vertical position sensing system, and the second car device; and installing a connection system between the first and second communication systems. In further aspects the connection system may be an interface between the second communications system and the elevator controller. In some aspects the connection system may be an interface between the second independent system and the plurality of button devices of the first system. In some aspects the connection system may be an interface between the second independent system and the first car device. In some aspects the interface may serve to provide analog signals from the second communications system to electrical relays of the elevator controller. In some aspects the interface may also serve to sense the opening and closing of elevator controller electrical relays under the direction of the elevator controller. In some aspects, the connection system comprises a control interface device that receives signals from each of the second floor devices (and/or second car device) and transmits analog signals to the relays of the elevator controller. In some aspects, the connection system comprises a control interface device that receives signals from the second car device and transmits communications consistent with those received signals to the elevator controller or the first car device. In some aspects, the method includes the step of connecting the control interface device to the elevator controller electrical relays in a manner configured to sense the opening and closing of those relays. In some aspects, the connection system comprises a control interface device that receives signals from each of the floor devices and/or the car device, and transmits digital signals to the elevator controller.

In some embodiments, the present invention comprises the aspects of a universal independent floor device for positioning proximate an elevator system, the device may have a display adapted to display the direction of travel and floor location of a particular elevator car; a data communications port for sending and receiving data communications to an elevator independent control device; and communications systems for communicating with user mobile devices proximate the floor device; and communications system for communicating with an independent second vertical position sensing system. In some aspects, the universal floor device further may comprise one or more of: a camera and processor adapted to identify persons proximate the device; detect social distance of proximate persons and the properly wearing of a mask, the number of people entering the elevator, the number of people awaiting the elevator, any aggressive/suspicious behaviors in the elevator and/or in the proximity of the landing, a temperature sensor adapted to sense the temperature of each identified person; and processing systems to signal an alert if the sensed temperature of any identified person is outside a predefined range, and processing systems processing each of the above as well as signaling to the elevator independent control device.

In some embodiments, the present invention comprises a universal car device which may, in some instances, be enabled to detect the vertical position of the elevator car. The universal car device may have one or more of a display adapted to display the direction of travel and floor location of the car; a data communications port for sending and receiving data communications to an elevator independent control device; a data communications port for sending and receiving data communications with the first elevator car control input panel; data communications components for communicating with one or more other components of the independent system; and communications systems for communicating with user mobile devices proximate the universal car device and/or one or more floor devices; and/or communications systems for communicating with an independent second position sensing unit. In some aspects, the universal car device further may comprise one or more of: a camera and processor adapted to identify persons proximate the device; detect the social distance of proximate persons, the number of people entering the elevator, any aggressive/suspicious behaviors in the elevator car, a temperature sensor adapted to sense the temperature of each identified person; and processing systems to signal an alert if the sensed temperature of any identified person is outside a predefined range, and processing systems processing each of the above as well as signaling to the elevator independent control device, a processing system to detect the distance between the independent car device and the independent floor devices. In some embodiments, the universal second car device may determine or recognize whether a passenger who has selected a defined destination has or is boarding the car; or whether a passenger that has selected a given destination is or has not disembarked when the elevator car arrives at the given destination; or whether the passenger(s) are able to keep the elevator doors open if theirs hands are busy holding goods until the passengers authorize the doors to close.

In some embodiments, aspects of the present invention may comprise a method of upgrading an existing elevator system having a first hall floor device, a first car device, a first elevator controller and a first communication system connecting the first hall floor device, first car device and first elevator controller, the method comprising: installing a second control system comprising at least one second hall floor device and a second communications system; connecting the second system to the first system, such that the first system maintains direct control over operations of the elevator car; the second system inputs additional elevator user system calls/directions to the first system; the first system carries out the directions from the second system; the second system collects control information from control mechanisms of the first system and/or communicates at least a portion of the collected information to a user of the second system. In some aspects, the method may comprise installing second control systems that may be touchless, may accomplish biometric recognition (such as: face, etc.), that may comprise smart processing modules to learn from operations and user interactions and predict various events, decisions, and/or selections or such, may have interface with user mobile devices, and the interface may automatically function at one or more alternate second control systems at other locations.

In some embodiments, the system can serve as an "external" or "independent" supervising system which collects data on events and other aspects of the otherwise "pre-existing" elevator system. This "external" or "independent" aspect of the system can provide information to elevator users and owners from a perspective "external" to or "independent" from the existing elevator control systems. Further aspects are also described below.

FIGS. 1.*a*.1, 1*a*.2, 1*a*.3 (and 1.*b*.1, 1.*b*.2, 1.*c*.1, 1.*c*.2, 1.*c*.3, 1.*d*.1, and 1.*e*.1, 1.*e*.2) illustrate schematics of various embodiments of the present invention as may be applied to an exemplary elevator system.

The components and aspects described in this paragraph are those of a prior art exemplary elevator system as generally illustrated in portions of FIG. 1.*a*.1 (It should be noted, however, that FIG. 1.*a*.1 also shows aspects of certain embodiments of the present invention.) Components of the prior art exemplary elevator system shown in FIG. 1.*a*.1 comprise an elevator car 12 in a hoistway 14 or elevator shaft of a building. Also represented in FIG. 1.*a*.1 are exemplary floors 1 through 5 (shown at 16A-16E) serviced by the elevator with respective hall doors 18 at each floor for access to the elevator car 12. Not shown in FIG. 1.*a*.1, but typically present in a prior art elevator system is also a first vertical position sensing system that generates data signifying or representing the vertical position of the elevator car 12 in the hoistway 14. In the exemplary system, elevator passengers can call the elevator from the various floors by pressing an elevator call button (not shown) on an elevator call plate, sometimes termed a "floor device", (also not shown) on each floor. Further, elevator passengers once inside the elevator car 12 can select a target or destination floor by selecting the targeted floor on an internal elevator control panel (not shown) of the elevator car 12. Operations of the elevator are controlled by an elevator controller 20 which historically may have been located in an elevator machine room (not shown). However, in many elevator designs there may exist no formal machine room and/or the elevator controller 20 may be physically located in any number of locations operatively near the elevator. The elevator controller 20 responds to elevator calls placed from passengers at any of the floors as well as target floor selections made by passengers via the internal elevator control panel. Additionally, the elevator controller 20 manages the safe operation of the elevator through protocols defined in the controller 20, such protocols including safeguard procedures in elevator car 12 travel, door opening and closing, loading of elevators as well as other operations.

In FIGS. 1.*a*.1 through FIG. 1.*e*.2 are also shown components of an independent universal digital control system 10 or Elevator Universal Digital Assistant ("EUDA") according to aspects of various embodiments of the present invention. The term "universal" is not limiting but, instead, descriptive of particular embodiments which can be relatively universally applied to existing or future elevator systems regardless of differences arising from unique original equipment manufacturer (OEM) designs or existing elevator control wiring or other elevator control data communications. Further, the term "independent", while used in the present disclosure and descriptive of certain aspects of particular embodiments of the present invention is not, and should not be taken as, definitive of or applying to every component or embodiment of the present invention. Further, the term "independent" as used herein may in certain embodiments characterize components, systems, or methods as being independent or substantially independent from previously installed or separate elevator control systems.

Generally stated, FIGS. 1.*a*.1 through FIG. 1.*e*.2 relate to aspects of certain embodiments of the present invention. Illustrative examples of certain aspects of various embodiments such as shown in FIGS. 1.*a*.1 through 1.*e*.2 are shown in FIGS. 6-10.

In some embodiments, the independent universal digital control system may comprise, among various other possible components, independent universal hall floor devices (described below), independent universal position sensor system(s) (described below), independent car universal devices (described below), one or more universal independent control devices (described below), modules to send data to and received data from a user's and/or owner's mobile phone, components and methods to provide supervision and monitoring of the elevator system; components and systems to groom signals from the independent universal digital control system to an existing (first) elevator system in such a fashion that the signals from the independent universal digital control system mimic signals sent in the existing (first) elevator system.

The Illustrative Embodiment of FIG. 1.*a*.1

As stated above, FIGS. 1.*a*.1-1.*e*.2 illustrate schematics of various embodiments of the present invention as may be applied to an exemplary elevator system. In FIG. 1.*a*.1, an independent Hall Universal Floor Device ("HUFD") 24 is shown at each of floors 1 through 5 proximate the hall door 18 for the respective floor. The HUFD 24 may be positioned so as to present as a panel on a wall near hall door 18. An embodiment of an Independent Universal Position System ("IUPS") 23 is illustrated in FIG. 1.*a*.1 as a laser system (or encoder or other sensor or wired system) that may extend vertically in hoistway 14 to determine the vertical position of the elevator car 12. FIG. 1.*a*.1 also shows an Independent Car Universal Device ("ICUD") 25 in the elevator car 12. The ICUD 25 may be configured to be in wired or wireless communication with one or more HUFDs 24 and/or a Universal Independent Control Device ("UICD") 30 described below. The ICUD 25 may be configured to receive wireless, optical or other signals from a user mobile phone 8 (or other user device). Exemplary signals received at the ICUD 25 from the mobile phone 8 may be user choice of target or designated floor destinations for the elevator. Further, other signals such as "emergency stop", "close door", "hold door open", "open door", "call emergency services" and other actions customarily implemented via the elevator control panel may be received by the ICUD 25 and further communicated to components of the independent system 10. Further, the ICUD 25 may receive signals from various of the components of the system 10 and transmit those signals to the user mobile phone 8 and/or display on a display of ICUD 25 the direction of travel and floor location of the elevator car 12 (as well as other information) and/or emit audio signals or speech communications. The ICUD 25 as well as the HUFD's 24 may be battery powered or powered from a power source in the elevator 12. As more fully described hereinafter, the ICUD 25 may comprise a battery backup as well as a motion detector, camera, thermal camera and/or sensor, microphone, speaker, processors and memory devices to facilitate the functions of ICUD 25.

As also shown in FIG. 1.*a*.1, the HUFDs 24 may be connected to a universal independent control device ("UICD") 30, which communicates with the elevator controller 20. A wireline communication 32 provides signal communication between each of the HUFDs 24 of FIG. 1.*a*.1 and the wireline communication 32 also extends to and provides signal communication from the HUFDs 24 to the UICD 30. In the embodiment of FIG. 1.*a*.1, the UICD 30 is located proximate the elevator controller 20 in the elevator machine room and connected to the elevator controller 20. In alternate embodiments, the UICD 30 may be positioned in other locations or integrated into an HUFD 24 or ICUD 25 and/or communicate with the elevator controller 20 via one or more wireline or wireless protocols. Additionally, as pointed out above in some embodiments there is no formal machine room associated with the elevator system and the elevator controller 20 may be located in a variety of locations.

Further, as shown in the embodiment of FIG. 1.*a*.1 the wireline 32 communications from the plurality of HUFDs 24 can be readily mounted within the hoistway 14 or elevator shaft providing a simple system for retrofitting the universal digital control system 10 to an existing elevator system. (It should be pointed out that the schematic of an embodiment of the present invention shown in FIG. 1.*a*.1 appears to show the wireline 32 positioned outside the hoistway 14. However, this appearance is simply for clarity in the schematic to illustrate the wireline 32 connections to each HUFD and to the UICD 30. However, in some embodiments, the wireline 32 may indeed be positioned outside the hoistway 14.) The wireline 32 communications may comprise a simple direct string of two wires from the plurality of HUFDs 24 to the UICD 30, providing serial digital communications between the HUFDs 24 and the UICD 30. Each of, or particulars of, the components of the universal independent digital control system 10 can be provided with battery backup to facilitate operation of the system 10 even with interruptions to other electrical services to the elevator or building. In such fashion, each of the UICD 30, the ICUD 25, the IUPS 23 and the plurality of HUFDs 24 can be provided with battery backup. With battery backup in this manner, certain embodiments maintain their monitoring of the elevator system, maintain communications with and between the various components of the universal digital control system 10, maintain displays (such as shown below) in the HUFDs 24 and ICUDs 25 (as well as, in some embodiments, other system components) and also maintain the capability of continued communication with user mobile devices 8 even in the event of power failure of the elevator control system or the entire building in which the elevator is housed. In some embodiments, the wireline may comprise more than two wires, in other embodiments the wireline 32 may be substituted by wireless communication equipment and functionality and/or a combination of wireline and wireless communication systems. In some embodiments, the UICD 30 receives data from the IUPS 23 (either via HUFDs 24 and wireline 32, wirelessly from HUFDs 24, wirelessly from IUPS 23 or wired from IUPS 23). Based on the data from the IUPS 23, the UICD 30 (and/or other components of the system 10 such as ICUD 25 or HFUD 24) may always know the vertical location of the elevator car 12. Shown at 32.*a* is a communications link from the IUPS 23 to one or more of the components of the system 10. The UICD 30 will also have received call signals (and/or other data) from HUFD's 24 and or from ICUDs 25. The UICD 30 serves to pass appropriate signals (call, target floor, and/or other signals) to the elevator controller 20, but may also communicate directly or indirectly back to HUFDs 24 and/or ICUDs 25 data such as the vertical location of the elevator car 12, ETA of the elevator car 12 to call or target floors, command floor destinations from elevator controller 20, and/or other data. All or portions of such data, or other information of the digital control system 10, may be displayed at HUFDs 24 and/or ICUDs 25 and may also be communicated to an elevator user's mobile phone 8. The UICD 30 may also serve to track data about elevator activities and events. The UICD 30 may also include communication port(s), either wired or wireless, to communicate data. In some embodiments, the UICD 30 may direct communications from the system 10 to elevator users.

In some embodiments of the control system 10, an alternate component/embodiment to the UICD 30 (or 130) may be utilized. Examples of aspects of certain embodiments of these components are shown in FIGS. 6, 7, 8, 9 and 10 and discussed more fully below. Generally stated, these embodiments may utilize a Universal Interface Device ("UID") 131 instead of the UICD 30 (or 130). The UID 131 may function primarily as only an interface device communicating with the existing elevator 150 controller (or controller 20) and the intelligence of the system 10 as more fully discussed below) is embodied in one or more HUFDs 24 (or 124) or in a car device or in a control device or other component of the present system. In some embodiments, the UID 131 functions to convert signals (such as from a EUDA control device, the ICUD 25 (or 125) or one or more HUFDs 24 (or 124) intended for transmission to the existing elevator machinery 150 or elevator controller 20 to the proper format and/or pinout of the existing elevator machinery 150 or elevator controller 20. In some embodiments the UICD 30 or UID 31 generate signals for transmission to the elevator machinery 150 or elevator controller 20 which mimic the signals that may otherwise be sent to the machinery 150 or controller 20 by the elevator call buttons or elevator control panel. In some embodiments, such "mimic" signals from the system 10 are indistinguishable to the machinery 150 or controller 20 from the signals received from the elevator call buttons or elevator control panel.

Further, in some embodiments the UICD 30 or UID 31 functionality can be built into other components—such as HUFDs 24 (and/or ICUDs 25 and/or other components of system 10 such as an independent control device)—so that the other components (or components of the system 10) can communicate directly with existing elevator machinery 150 or elevator controller 20.

In other embodiments, data from the IUPS 23 may be communicated directly or indirectly to one or more HUFDs 24 and/or the ICUD 25 and/or the UICD 30 and/or other components of the system 10 (see, for example the schematics from FIG. 6 to FIG. 10).

As also shown in FIG. 1.*a*.1, the system 10 may also comprise a mobile phone 8. The system may also comprise an application (or app), in some instances termed the Elevator Universal Digital Assistant app 33 that can be downloaded to a user's mobile phone 8. The user can be prompted to download the app 33 as the user approaches the elevator and the app 33 may be wirelessly downloaded from a HUFD 24 or other component of the system 10. Or, the app 33 can be otherwise downloaded through various techniques such as from an app store, or triggered when the user enters the building or structure. Additionally, the app 33 can be loaded into the mobile phone 8 to be used at any of a plurality of elevator installations wherever the user goes so long as the "other" elevator systems utilize the EUDA systems. Since the control system 10 can be universally fitted to virtually any elevator system, a single application 33 can be used at a plurality of elevator installations (which use an embodiment of control system 10). Accordingly, in some embodiments a single user may use the same mobile phone app 33 in almost every installation of the present universal independent digital control system 10. The HUFD 24 and the ICUD 25 devices may include a smart reader or other communication systems to interface with the user's mobile device 8. Such communication systems may include Bluetooth and other local wireless data communication protocols and systems.

In some embodiments, the system 10 may comprise an independent control component in functional communication with other components of the system 10. The independent control component may be configured to process received signals corresponding to elevator passenger call inputs, passenger floor destination inputs, and elevator vertical position data and generate an elevator car travel itinerary based on the processed signals. The independent control component may generate command signals for transmission to the elevator controller to cause the elevator controller to provide elevator car service conforming to the generated elevator car travel itinerary. The independent control component may further dispatch the generated command signals, or signals representing the same, such that they may be communicated to the elevator controller. In some embodiments, the UICD 30 (or 130) may comprise the independent control component. In some embodiments, one or more HUFD 24 (or 124) may comprise the independent control component. In some embodiments, the ICUD 25 (or 125) may comprise the independent control component. In some embodiments, the independent control component may be comprised as a component other than an HUFD 24, UICD 30, or ICUD 25.

In some embodiments, such as an instance wherein only one passenger presents to the system 10, the itinerary may be a straightforward response to the passenger's call for service. For example, if the elevator car is at floor 6 and with no passengers on board and in a stationary state and a passenger submits a call for service at the first floor, the generated itinerary may be a simple command to dispatch the elevator to the first floor so as to pick up the passenger. In such instances the itinerary may comprise the simple dispatch to floor 1 and, so, the itinerary may be spoken of as being "identified" (from the service call) and then transmitted to the elevator controller. However, even in this instance, the itinerary may become more complicated and, so, may be spoken of as being "generated" by the control component. For example, if during the travel of the elevator car to the first floor service calls for descending service are input from separate floors (for example floor 4 and floor 3), the control component may generate an itinerary that adds stops at both floor 4 and floor 3 and transmit appropriate itinerary commands to the elevator controller so that the elevator stops at floors 4 and 3 to pick up the descending passengers at those floors. It can be seen in this fashion that the control component may receive and process inputs from service calls and target floor destinations and also process data from an elevator vertical position sensing system to generate travel itineraries to meet the passenger requests and while yet complying with order of service command protocols that may have been provided to the control component. In addition, in the instance of a plurality of elevators at a single facility, one or more control components may singly or cooperatively generate separate itineraries for each of the elevators to provide optimized service to the passengers presenting to the system. Further, itineraries may be generated that take into account priority of passengers or priority of floors serviced or other rules or priorities as may be defined and provided to the elevator controller from time to time.

In some embodiments, the system may comprise an independent interface component configured to groom dispatched command signals from the independent control component such that the groomed command signals mimic signals received by the elevator controller from the first floor devices and the first car control input panel. In some embodiments, the system 10 is configured such that the groomed dispatched command signals from the independent interface component may be communicated to the elevator controller. In some embodiments the independent interface component may comprise the UID 31 (or 131) and may comprise a separate device in the system 10 or may comprise functionality otherwise embodied in other components of the system 10, such as a HUFD 24, the ICUD 25, and/or the UICD 30.

The Illustrative Embodiments of FIG. 1.*a*.1 to FIG. 1.*e*.2.

The embodiments shown in FIGS. 1.*a*.1 to 1.*e*.2 are organized and labelled to conveniently illustrate various embodiments.

FIGS. 1.*a*.1; 1.*a*.2; and 1.*a*.3 illustrate embodiments wherein a separate IUPS 23 device, in some instances an independent positioning system not a part of is utilized as part of the system 10. Each of these Figures also shows, as indicated in the notes on the Figure, a configuration wherein optionally a separate UID 31 or UICD 30 may be included or omitted. Also, in each of these Figures, as explained in the legend, the dotted line indicates communication via wired, wireless or pre-existing wire systems. FIG. 1.*a*.1 illustrates an embodiment with a separate IUPS 23 wherein the system 10 also includes HUFD's 24 and an ICUD 25. FIG. 1.*a*.2 illustrates an embodiment with a separate IUPS 23 but without any HUFDs 24. FIG. 1.*a*.3 illustrates an embodiment which does not include an ICUD 25.

FIG. 2 illustrates an exemplary embodiment of an UICD 30 having a functional printed circuit board (PCB) 34 having memory, processor, firmware and software and configured to receive and process data communications from one or more HUFDs 24 and may also receive and process data from other system 10 components such as the IUPS 23 and ICUD 25. The PCB 34 may be configured to process signals received and send signals to one or more of analog interface board 36 or serial interface board 38. Signals from either or both of the analog interface board 36 or serial interface board 38 may then be communicated to the elevator controller 20. The signals from UICD 30 to elevator controller 20, in some embodiments, may be fashioned to replicate or mimic the signals the elevator controller 20 normally receives from the elevator call buttons or those signals from the elevator internal control panel which represent the designated or target floor selected on that internal control panel by the elevator user (or other signals from the existing call buttons or control panel(s)). FIG. 2 shows interface board 36 outputting signals "1", "2", "3", "4", and "5" corresponding to call signals or target floor destinations of any of illustrative floors 1 through 5. Accordingly, signals (of elevator "call" and target or designated floor selection) passed to the elevator controller 20 from the universal independent control system 10 (via the UICD 30) are, in particular embodiments, identical to and indistinguishable (to the elevator controller 20) from those signals which would be otherwise received at the elevator controller 20 from the first elevator call buttons or elevator internal control panel. Accordingly, the addition of the universal independent digital control system 10 of certain embodiments of the present invention can simply "lay over" the existing signal input to the elevator controller 20 and do so without altering any of the designed safety or operational steps programmed into and followed by the elevator controller 20 once it has received signals from either call buttons or elevator internal control panels (or digital system 10). The universal independent control system 10 can, via UICD 30, also pass a variety of other predefined signals to elevator controller 20 (such as emergency stop or other signals). In some embodiments the UICD 30 or UID 31 (or UICD 30 and/or UID 31 functionality) may be integrated into one or more HUFD 24 and/or ICUD 25 and thereby the HUFD's 24 or ICUD 25 may communicate directly with the elevator controller 20 without using a separate UICD 30 or UID 31. In some embodiments, an ICUD 25 with integrated UICD 30 or UID 31 functionality can be connected directly to the first communications system in the elevator car (such as at or by way of the circuits and button circuits of the elevator car control panel) and/or can also communicate with the elevator controller 20 (or other components) via the second communications system. In some embodiments, a HUFD 24 with integrated UICD 30 or UID 31 functionality can be connected directly to the first communications system at, or in conjunction with, the elevator call button at the respective floor of the HUFD 24 and/or can also communicate with the elevator controller 20 (or other components) via the second communications system.

By way of example, in some embodiments the analog outputs of analog interface board 36 may be connected to relays (not shown) of the elevator controller 20. By way of explanation and background, in some embodiments the elevator controller 20 (absent the present invention) may control movement of the elevator car 12 to a destination floor by outputting an analog signal to the connected relay assigned to the destination floor, with a separate relay dedicated to each floor served by the elevator. In some embodiments, when the present digital control system 10 is connected to such a set of relays, a separate conductive connection is made from the analog interface board 36 to each of the separate relays. Thus, the analog output from analog interface board 36 corresponding (for example) to floor 3 may be connected by an electrical conductor to the elevator controller 20 relay assigned to floor 3. In the same fashion, each of the other analog outputs from analog interface board 36 may be connected by an electrical conductor to the elevator relay corresponding to the appropriate analog output. In further explanation, when such an embodiment of the present control system 10 is connected to the appropriate relays, the control system 10 can send analog signals, duplicative of (or mimicking) those otherwise sent to the relay by the elevator controller 20, to direct the elevator car 12 to any of the floors assigned to the relays. In some embodiments, there will be no difference in the analog signal received by the relays between those originating from the original controller 20 or the analog interface board 36 of the present invention. Accordingly, the addition of the universal independent digital control system 10 of certain embodiments of the present invention can simply "lay over" the existing signals input to the elevator controller 20 and do so without altering any of the designed safety or operational tasks programmed into and followed by the elevator controller 20 once it has received signals from either call buttons or elevator control panels (or digital system 10). It should also be noted that in some embodiments, a HUFD 24 on a particular floor can be operatively connected to the call button circuit of the existing call button on the particular floor. One or more signals, such as an analog signal, from the HUFD 24 to the call button circuit can then activate the call button circuit such that the call button circuit transmits its "normal" call signal to the elevator controller 20 via the call button's existing communications pathway to the controller 20. In this way, speaking generally, the elevator controller receives a standard signal via its standard communications pathway from the call button and can respond appropriately, but the call button circuit was actually activated by the signal(s) from the HUFD 24 on that particular floor. By these methods, the HUFD's 24 can effectively communicate with, and direct, the controller 20 via the existing communications system extending between the respective call buttons and the controller 20. In such instances the HUFD 24 can provide a signal to the call button circuit mimicking the call button normal signal or otherwise activate the call button circuit so that a "call" signal is sent from the particular call button to the controller 20. In similar fashion, an ICUD 25 can be operatively connected with the several buttons or button circuits in the elevator car control panel. By activating the appropriate button circuit of the elevator control panel, instructions from the system 10 (or more directly from the ICUD 25) can be transmitted from the system 10 to the controller 20 via the elevator car control panel circuits and their respective signaling paths and signal inputs to the controller 20.

Also, in some embodiments of the present invention, the electrically conductive connection from the outputs of the analog interface board 36 to the respective relays also convey an electrical signal back to the analog interface board 36 when the relays are activated such as by one or more analog outputs from the elevator controller 20 to the respective relays. In this fashion, in some embodiments, the digital control system 10 is informed of elevator controller 20 activation of particular relays (and the controller's 20 command to send the elevator to a particular floor).

In somewhat similar fashion the serial interface board 38 may be connected to appropriate connections in an elevator controller utilizing digital input/outputs. The digital control system 10 can then send and receive digital signals either directing movement of the elevator car 12 or tracking actions otherwise directed by the controller 20. Further, in some embodiments other communication systems or interfaces may be used between the existing elevator system (including, in some instances, controller 20)

The data received at either the analog interface board 36 and/or serial interface board 38 from the elevator controller 20 and/or the controller relays can be processed and/or communicated to other components of the digital control system 10.

Additionally, signals from the UICD 30 may be transmitted to one or more of the HUFD 24 (and also to the ICUD 25) such as for control purposes as well as to support audio or visual output from the HUFD 24 (or ICUD 25), including output such as shown in FIG. 4. Further, the HUFD 24 and/or ICUD 25 can transmit to user mobile device 8 via local communication systems signals from the universal digital control system 10 such as Bluetooth, digital readers, and other known protocols.

The Illustrative Embodiment of FIGS. 1.*b*.1 and 1.*b*.2 and 1.*b*.3

FIGS. 1.*b*.1, 1.*b*.2, and 1.*b*.3 illustrate embodiments of the system 10 in which the vertical position of the elevator car 12 is determined via alternate techniques and systems from that presented above, such as by triangulation between components of the ICUD 25 and respective HUFD's 24. As alternatively shown, the vertical position may be determined by use of components disposed on the landing of the floors and one or more complimentary components fixed on the elevator car 12.

FIG. 1.*b*.1 illustrates and embodiment utilizing, inter alia, HUFD's 24, a ICUD 25 with UICD 30 or UID 31 functionality included in other components or otherwise provided in a separate unit. This embodiment illustrates methods of the system 10 determining the vertical position by way of triangulation between the HUFD's 24 and the IUCD 25.

FIG. 1.*b*.2 illustrates another set of embodiments wherein the system 10 does not include a ICUD 25 but does comprise HUFD's 24. The HUFD's are functionally connected with sensor combination components 26 and 28 (discussed below in conjunction with FIG. 1.*c*.1). In some embodiments (see FIG. 1.*b*.1) UICD 30 or UID 31 functionality may be embodied in one or more of the other components of the system and an otherwise distinct UICD 30 or UID 31 component may be omitted from the system. Further, in some embodiments (see FIG. 1.*b*.1) respective HUFD's 24 may be connected to existing first floor buttons and therefore to the elevator controller 20 through existing first system communications pathway, or via wireline or wireless 32 (there may be no UICD 30 or UID 31 in this case) and the function of the IUPS 23 (i.e., providing system 10 with vertical position data of the elevator car 12) may be realized through HUFD 24 and ICUD 25 relative positions triangulation. This is possible as HUFD's 24 contain the information or identity of their relative floor installation or location. In some embodiments, HUFD's 24 (FIG. 1.*b*.2, 1,*c*.1, 1.*c*.2) may be connected to sensor components 28 at the floor. In some embodiments (see FIG. 1.*b*.1) ICUD 25 may be connected to the first elevator car control panel and therefore to the elevator controller 20 through wireline or wireless 31 (there may be no separately distinct UICD 30 or UID 31 in this case) and vertical positioning of the elevator car may be determined by the HUFD 24 and ICUD 25 by using relative positions triangulation. This is possible as HUFD's 24 contain the information of their relative floor installation. In some embodiments, ICUD 25 (FIG. 1.*b*.3, 1.*d*.2) may be functionally connected to sensor combination 26/28.

FIG. 1.*b*.3 illustrates embodiments which do not include HUFD's 24, but utilize an ICUD 25 functionally connected with sensor component system 26/28 so as to be informed of the vertical position of the elevator car 12. The ICUD 25 may also be functionally connected with one or more circuits or button circuits of the existing elevator car control panel so as to transmit its instructions or command signals to the controller 20 via the existing elevator car control panel communications systems. Alternatively, the ICUD 25 may utilize other wireline or wireless communications systems to transmit its command signals to the controller 20.

The Illustrative Embodiment of FIGS. 1.*c*.1 and 1.*c*.2

FIG. 1.*c*.1 illustrates aspects of certain embodiments of the digital control system in which the IUPS 23 comprises a sensor assembly shown as one sensor component 26 and complimentary other sensor component 28 which are shown attached, respectively, to the elevator car 12 and proximate the hall door 18 on each floor. The second sensor component 28 of each floor is in communication with the HUFD 24 (or, 24.1) of the same floor. The one and other sensor components 26 and 28 are configured to accurately sense and report to the HUFD 24 data showing the position and direction of travel of the elevator car 12. In the embodiment of FIGS. 1.*c*.1 and 1.*c*.2, each second sensor 28 is connected to its respective HUFD 24 by wireline communications, although in alternate embodiments the second (and/or first) sensors can communicate to the HUFDs 24 or other components (including but not limited to Independent Car Universal Device ICUD 25—described below—and/or the Universal Independent Control Device UICD 30) of the universal digital control system 10 by one or more wireless protocols. In some embodiments, a combination of wired and wireless communication systems may be used to communicate signals or data from the components 26 and 28 to other components of the digital system 10.

It should be noted that sensor units 26 and 28 (FIG. 1.*b*.2, 1.*b*.3, 1.*c*.1, 1.*c*.2, 1.*d*.2) are illustrative of only certain IUPS 23 embodiments. Other configurations or types of sensors may be used in various IUPS 23 embodiments to determine the vertical position of elevator car 12. Position systems such as laser may extend vertically in hoistway 14 to determine the vertical position of the elevator car 12 and may be used as IUPS (see, for example FIGS. 1.*a*.1, 1.*a*.2 and 1.*a*.3 and FIG. 6) and accompanying description). Additionally, other sensing systems may also be utilized (such as encoders or signals from the pre-existing systems and others).

In some embodiments HUFD 24 may comprise a board that exchanges signals with the user's mobile phone 8, such as is shown in FIGS. 1.*a*, 1.*b*, 1*e*. Further, in some embodiments HUFD 24.1 (FIG. 1.*c*) is a device including several elements such as HPI (Hall Position Indicator) and or HDI (Hall Direction Indicator) integrated with the board exchanging signals with the smartphone and wired or wireless to the active part of the IUPS 28

The Illustrative Embodiment of FIGS. 1.*d*.1 and 1.*d*.2

In some embodiments HUFD 24.2 (FIG. 1.*d*) may comprise several elements such as HPI (Hall Position Indicator) and HDI (Hall Direction Indicator) integrated with the board exchanging signals with the smartphone. In some embodiments the positioning of the car is determined by triangulation between the ICUD and the HUFD (FIG. 1.*d*.1). FIG. 1.*d*.2 illustrates aspects of certain embodiments of the digital control system in which the IUPS 23 comprises a sensor assembly, shown is one sensor component 28 and complimentary other sensor component 26 which are shown attached, respectively, to the elevator car 12 and proximate the hall door 18 on each floor. The other sensor component 28 is in communication with the ICUD 25 by wireline communications, although in alternate embodiments the second (and/or first) sensors can communicate to the ICUD 25 or other components (including but not limited to the HUFD's 24—described below—and/or the Universal Independent Control Device UICD 30) of the universal digital control system 10 by one or more wireless protocols. In some embodiments, a combination of wired and wireless communication systems may be used to communicate signals or data from the components 26 and 28 to other components of the digital system 10.

In some embodiments the system may perform its operation without the ICUD (FIG. 1.*a*.3, 1.*b*.2, 1.*c*.2, 1.*e*.2). In some embodiments the system 10 may also include ICUD 25 (FIG. 1.*a*.1, 1.*a*.2, 1.*b*.1, 1.*b*.3, 1.*c*.1, 1.*d*.1, 1.*d*.2 and 1.*e*.1). In some embodiments the system may perform its operation without the HUFD's as per FIGS. 1.*a*.2, 1.*b*.3, 1.*e*.1 and 1.*e*.2.

The Illustrative Embodiment of FIGS. 1.*e*.1 and 1.*e*.2

In some embodiments such as illustrated in FIG. 1.*e*.1, the system 10 may be configured to operate with an ICUD 25 for commands and or monitoring. In some such embodiments, communication from a user's mobile phone 8 to the control system 10 may be accomplished wirelessly from outside or inside the elevator car 12 to other components of the control system just to exchange information or input data. In some other embodiments (see FIG. 1.*e*.2) the communication from a user's mobile phone 8 to the control system 10 may be accomplished wirelessly to the UICD 30 device only (data inputs and monitoring).

Data underlying that displayed in the floor position display 40 (FIG. 4) and elevator travel direction indicator 42 may, in some embodiments, be collected by a IUPS 23 device and other sensor components 26 and 28 (or other sensing units), passed to an HUFD 24 or to the ICUD 25.

Figure 3:
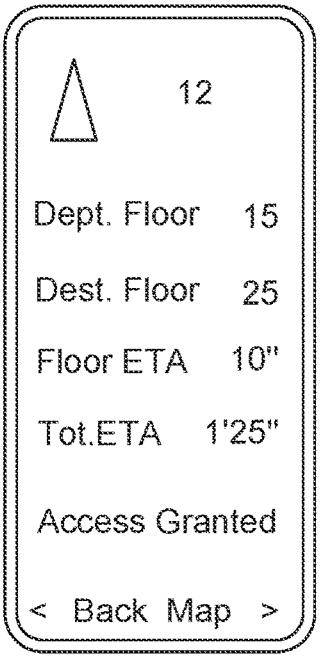
FIG. 3 illustrates an example of a user mobile device display according to one or more embodiments.

FIG. 3 illustrates an exemplary embodiment of a user mobile device 8 displays using the application 33 according to certain embodiments. In this particular case the application 33 displays on the mobile device 8 of a particular user an indicator of the direction of travel of the elevator car 12, the current floor at which the elevator car 12 has been sensed, the user's departure floor, the user's destination floor, an estimated time of arrival of the elevator car 12 to the destination floor of the user calculated from the current floor of the user, and an indication that access to the destination floor has been granted by the control system 10. The estimated time of arrival of the elevator car 12 can be calculated by the system 10 by tracking the position, direction and speed of the elevator car (as determined by the system 10) and correlating with that data any intervening stops or travel directions for the elevator prior to its anticipated arrival at the floor of the user. The messages displayed on the mobile device may be customized.

FIG. 4 (including FIGS. 4.*a*1, 4.*a*2, 4.*b*1, 4.*b*2, 4.*c*1 and 4.*c*2) illustrates exemplary embodiments of HUFD 24 components according to certain aspects of the present invention. Shown is a floor position display 40 and or elevator travel direction indicator 42 as well as a micro/reader/transmitter 44. Data underlying that displayed in the floor position display 40 and or elevator travel direction indicator 42 may, in some embodiments, be collected by a IUPS 23 (or other sensing units), passed to an HUFD 24/ICUD 25 and then transmitted through the application 33 to be displayed on the mobile device 8 of a particular user. In some embodiments HUFD 24 (and ICUD 25) also includes audio capabilities including a speaker and/or a microphone to provide or collect audio information or using the audio capabilities of the user's mobile phone to transmit and receive messages to accommodate disabled persons. In some embodiments, a display may not be included in the HUFD 24 and information (such as that shown in FIG. 3 or 4) is displayed on the user mobile device 8 through the app 33. In some embodiments the information (such as that shown in FIG. 3 or 4) is displayed on both the user mobile phone 8, the HUFD 24 and/or the ICUD 25. The system 10 may interact with the user by way of the user's electronic device 8 (such as smartphone) through audio and/or visual signals (in some cases, messages to the user can be visually generated on the phone 8 and/or generated by the audio systems of the mobile phone 8.)

FIG. 4.*a*1 and FIG. 4.*a*2 illustrate aspects of two embodiments of HUFD 24 components and displays as might be configured to be used on a bottom floor of an elevator installation. Accordingly, each of FIGS. 4.*a*1 and 4.*a*2 show only an upwards direction option for elevator travel direction indicator 42. FIGS. 4.*a*1 and 4.*a*2 differ in the wireline communication setups of each embodiment. FIG. 4.*a*2 illustrates an embodiment so as to communicate via wireline 32 as illustrated extending from HUFD 24.2. FIG. 4.*a*1 illustrates an embodiment configured to communicate via both wireline 32 and wireline 29 which may extend to, and provide communications with complimentary second sensor component 28 (of an alternate embodiment IUPS). In similar fashion FIGS. 4.*b*1 and 4.*b*2 illustrate HUFD display embodiments as might be used on intermediate floors serviced by an elevator system. Also, FIGS. 4.*c*1 and 4.*c*2 illustrate HUFD display embodiments as might be used on a top floor serviced by an elevator system. (It should be noted that in some embodiments wireline 32 and wireline 29 may alternately comprise wireless communication systems or combination wired and wireless systems)

It can be seen that, in some embodiments, the universal digital control system 10 can be economically retrofitted into an existing elevator system. In such a retrofit, no changes need to be made to the existing systems of the elevator system except connection of the UICD 30 (or UID 30) to the elevator controller 20. It can be seen, then, that the universal digital control system 10, in certain embodiments, is fundamentally self-contained. It may collect elevator car 12 location and travel direction from its own vertical position sensor components IUPS 23 (or alternately separate IUPS components 26 and 28) (or other IUPS 23 sensing systems/units such as HUFD 24 and ICUD 25 relative position) and provides data communications between every HUFD 24 and the UICD 30 (or UID 30) by one wireline connection 32 that is easily disposed in the hoistway 14. As noted above, the HUFDs 24 may also communicate wirelessly with the ICUD 25 in the elevator car 12. Further, UICD 30 (or UID 30) may also communicate wirelessly directly with the ICUD 25.) Alternatively, communications between HUFDs 24 as well the ICUD 25 and the UICD 30 (or UID 30) may be accomplished by wireless communications. The elevator controller 20 after retrofit of the elevator system with a universal digital control system 10 of certain embodiments, continues to operate with all its preset operational and safety protocols unaffected by the addition of the universal digital control system 10 except that UICD 30 (or UID 31) provides "piggy-back" or "lay-over" data input to the elevator controller 20. But, in many embodiments, the data input provided by the IUCD 30 (or UID 31) to the elevator controller 20 is identical to (or mimics) the data input otherwise provided to the elevator control 20 by the pre-retrofit (as well as post-retrofit) elevator call buttons on each floor and the target or destination data signal sent to the elevator control 20 by the pre-retrofit (as well as post-retrofit) from the user input control panel in the elevator car 12. Thus, the universal digital control system 10 of particular embodiments can be "universally" applied to virtually any pre-existing elevator system in a very non-complicated fashion since the digital control system 10 does not interject into any of the proprietary controls or safeguards of the original elevator system. As also discussed herein, the system 10 can be configured to connect directly into the call button circuits already existing at each floor and/or into the button circuits of the elevator car control panel. In this fashion, the system 10 carries out all the designed control, management, and tracking of the system 10 while directly transmitting system 10 command signals to the controller 20 via the existing communication channels of the floor call buttons and/or elevator car control panel. Further, in some embodiments, the universal digital control system 10 can be locally managed and does not require WIFI or cloud internet exchanges to place an elevator call.

In some embodiments ICUD 25 (and/or ICUD 125, e.g., (from FIG. 6 to FIG. 10) may comprise one of more of the following features: display of elevator car 12 position, display of elevator car 12 travel direction, connection to the IUPS 23, wireless communications to one or more HUFDs 24, wireless communication capabilities to the user mobile phone 8 or other user device, the capability to detect whether the elevator car 12 light is on or off, the capability to detect the presence of a person or object in the elevator car 12, and/or an independent battery backup for the ICUD.

The digital control system 10 and its components can be provided with "smart" digital capabilities to facilitate sophisticated and evolving digital services by the system. The system 10 can provide smart features to the owner and user of the elevator system, thus easily upgrading a previously "dumb" or unsophisticated elevator system into an intelligent or "smart" elevator system. As an example of a smart functionality, the system 10 (or components thereof such as a HUFD 24 or ICUD 25) can recognize the mobile phone of repeat users of the system 10 and predict that a particular user (based on that previous user's use of the elevator system) will most likely wish to repeat a particular destination floor selection. Accordingly, when the particular user's presence is detected approaching a HUFD 24 or ICUD 25 the system 10 can anticipate the user's most likely floor destination objective, call an elevator to provide the anticipated elevator service, and notify the user's mobile device that a particular elevator is available (or arriving at with an identified estimated time of arrival) for the user's elevator travel. The user may enter the identified elevator car 12 and the system 10 can execute the appropriate elevator controls to deliver the user to his/her target destination floor without any action by the user. The system 10 can detect the user's entry and presence in the identified elevator car 12 and then proceed to close the door 18 and transport the user to the destination floor. In some embodiments, the system 10 can await a confirmation by the user of the "smart" identified target floor suggested by the system 10 prior to transporting the user. Since, in many embodiments, the application 33 can be universally recognized and used by any elevator system in which the universal control system 10 has been installed, a user may approach any such system 10 (regardless of whether the user has previously used the particular system 10), have the user's mobile device recognized via the system's interfaces and communications with the user's application 33 and enable the user to utilize his/her mobile device 8 to control the previously unused (by that particular user) elevator system. Further, since the control system 10 may be smart enabled, after one or more uses by the particular user the control system 10 may proceed to suggest an anticipated elevator destination for the user, and possibly after one or more confirmations by the user, automatically proceed to deliver the user to the anticipated destination floor without further prompting or input by the user. In embodiments where security measures are desired for user travel to particular floors, registration of the user and his/her mobile device may be input into the control system 10 prior to the user's use of the system 10 to access the secured floor(s). Further, tenants, residents or management of secured floors can easily send "pass authorization" to anticipated visitors of the secured floors mobile device 8 via text, email, the global application service or other techniques so that the application on the anticipated visitor's mobile device 8 can accept the sent and received "pass authorization" and communicate this "pass authorization" to the control system 10 when the authorized user approaches a HUFD of the particular system 10. Thus, secured access to particular floors can be controlled easily by the secured floor party without the intervention of resident security guards or other intervention. Further, capabilities of the system 10, such as for example ICUD) can confirm that the authorized user (and no one else) has entered a particular elevator car prior to the elevator car 12 being dispatched to the secured floor. In some embodiments, the application may include interfaces with scheduling or appointment software or such so that "pass authorization" is automatically conveyed to scheduled appointment visitor's mobile devices 8 in order to facilitate their automatic authorization to secured floors. Further the application 33 can notify the authorizing party of the arrival of the authorized user at the particular building or elevator proximity and the target arrival time of the visitor to the secured floor. Additionally, such notifications can be provided by the application 33 for the arrival of users to non-secured floors.

In some embodiments, the digital control system 10 may be configured to generate one or more alarms or other system actions/decisions when the presence of an unauthorized person is sensed in certain areas such as the elevator car, elevator lobby and/or other areas of a building or structure. In some embodiments, the digital control system 10 may be configured to implement certain actions at a detected security breach, or in instances such as when the elevator car may stop in the hoistway with passengers inside, or if suspicious behavior is detected in the proximity of the arrival landing near the elevator door of a floor. Further, certain embodiments may also be configured to sense or detect properly mask wearing, body temperature, biometric data recognition (i.e. face recognition, etc.), presence or proximity detection or recognition, social distancing, limited mobility of passengers or prospective passengers and to take predetermined action in such sensed or detected instances. The provision of such flexibly adapted and programmed control systems for the many existing and, comparatively, very "bare boned" control systems of older elevator systems, presents advantages with minimal retrofit or installation costs or difficulties, very low component cost, very high sophistication, and a platform that can be readily updated.

In some embodiments, all or portions of the smart functionality of the system may be embodied in each HUFD 24, only one HUFD 24, in the UICD 30, in the ICUD 25 or any combination thereof. Some embodiments provide universal processor enabled individual components that can be assembled into a complete control system 10 and/or assembled in plug and play fashion, as well as variations in processor implementations selected in setup of the components in the system. In other embodiments, the control system 10 may comprise only a limited number of smart processor units and linked components of the system 10 communicate with and utilize the limited number of smart processors to achieve overall satisfactory system functionality at lower component total cost.

In some embodiments, the digital control system 10 can thus upgrade a previously "dumb" elevator system into a "smart" elevator system that can recognize passengers mobile or other devices when the user or passenger approaches a building. The system 10 can then reserve elevator service through an application downloaded onto the user's mobile device 8 (or other electronic device). For passengers requiring security access services, the control system 10, in some embodiments, can confirm the passenger's permission for access and provide elevator service as the passenger approaches proximate the HUFD 24 or enter the car ICUD 25. In some embodiments, the control system 10 can communicate to the user's mobile device 8 the availability of the elevator service and the floor location and direction of travel of the elevator (as well as other information) being provided for the user service. Further, the control system 10 in some embodiments facilitates a completely touch-free user experience such that the elevator user may entirely call and command an elevator simply by using the user's mobile phone 8. Accordingly, a very simple elevator can inexpensively, quickly and efficiently be provided with an advanced digital touch free control system that upgrades the elevator to the most advanced digital experience—and that experience, one that can be continually updated by the simple step of updating the software and/or certain firmware of the control system 10.

The control system 10, due to its independent standalone design (being independent from the pre-retrofit elevator control system), can also show and or detect anomalies happening to the elevator systems operation thus providing a smart series of reports or alerts to the various building or elevator stakeholders depending on the type of the application to the control system (which may be based on various stakeholder configuration choices). In some aspects, due to its independent standalone design, the control system 10 can serve as an "external" or "independent" supervisor. Thus, the control system 10 may be, in some embodiments, seen as a doctor constantly monitoring the health of the elevator system to which it has been installed. Since the control system 10 may have its own IUPS 23, acceleration, vibration and noise sensors, extract controller 20 signals and information, and data analysis capabilities it can constantly accurately ascertain the performance as well as anticipate potential issues in the elevator system that may not otherwise be detected in the elevator system without specialists are inspecting the system.

The control system 10 increases over time the reliability of previously dumb elevator operation inasmuch as it may have no moving parts, is digital, and transforms the previously dumb operation of the elevator system into a smart elevator digital system. The control system 10 works as a parallel reliable system, actually supervising the dumb elevator—transforming the entire user experience with the elevator service into a preferred smart digitally enabled elevator experience. The control system 10 can be economically designed and produced to be universally applicable to the various designs of original equipment elevator services. Since the control system 10 is modular and intelligent it can support upgrades with add-on functionalities and features that provide value to stakeholders as additional services may be desired and/or digital capabilities develop.

The control system 10 can also provide independent performance analysis of the elevator system such as the number of runs and duration in every direction and floor destination, number of doors/locks opening and closing and the stopping accuracy at each floor, noise inside the car or due to the door operation as well car and doors vibrations. Further, with digital sensors in the machine room or other elevator equipment spaces, the control system 10 can log and confirm the presence of maintenance mechanics in the elevator machine room or other elevator equipment spaces. Additionally, the control system 10 can log passenger information including information such as direction and position of elevators. The system 10 can provide time savings such as by booking arrival of elevators in advance to the point of use and information such as ETA to dispatched floor and ETA to arrival to destination floor. Each or various of the HUFDs or ICUDs may incorporate cameras, motion sensors, temperature sensors, proximity sensors, light sensors, loudspeakers, micro and associated digital processors and software to facilitate many intelligent or smart systems controls or features. For example, the system 10 can provide security advantages such as aggressive behavior recognition (and, when recognized, trigger locking or opening doors as may be desired), passenger biometric data recognition (i.e. face recognition, etc.), surveillance camera operations, and client's phone number recognition. The control system 10 can also be provided with health and safety features including detection, recording and/or alerting of predetermined body temperature, predetermined social distancing, mass detection and air sanitation conditions as well as actuate air sanitation functions. The control system 10 can also provide usage safety such as activation of light in the elevator car 12 and other safety features such as elevator door 18 closing delay based on user conditions (such as a detected wheelchair, child stroller, or slow-moving person, stretcher, boxes are on the landing and/or are removed).

The digital control system 10, in some embodiments, may be designed in order to avoid any connection (apart from, in some embodiments, attachment of a ICUD 25 to the interior of the elevator car 12) to the elevator car 12 and therefore eliminates any need to run wires through the flexible cables 31 typically used to communicate with the elevator car 12 (in typical pre-existing elevator systems).

Since the control system 10 may include its own independent battery backup systems and its own elevator location sensing system it can serve to reliably provide accurate elevator car 12 actual location in the event of building power loss or emergency stoppage of the elevator. Accordingly emergency or other personnel approaching the elevator system can readily identify (such as from display of HUFD 24 or via application 33 communications to personnel mobile devices 8) the precise location of a stopped elevator car 12 without entering the hoistway or opening doors 18. In the same way the users are informed via smartphone or other devices if the elevator is out of service and where the cab is stopped.

The universal control system 10 can provide an equivalent to replacing the existing tactile buttons of the pre-retrofit elevator system, can provide intelligent building management systems, can provide software and devices to control access to buildings and can serve to provide an independent supervision of elevator operations.

In some embodiments the control system 10 has only a single point of attachment or connection to the pre-retrofit elevator system. That single point of connection may comprise the data communications between the UICD 30 (or UID 31) and the elevator controller 20. In some embodiments the control system 10 has one or more points of attachment or connection to the pre-retrofit elevator system. That alternative single point of connection or connection between the UICD 30 (or UID 31) and the ICUD 25 may be through the pre-existing car operating panel installed inside the elevator car or the HFUDs 24 and the pre-existing hall buttons installed at the landings or in other embodiments the ICUC 25 can be connected to the pre-existing car operating panel and the HUFD's 24 can be connected to the pre-existing hall buttons. In some embodiments the control system may have only a single point of attachment, connection or communication with the pre-retrofit elevator system—that single point may be an input to the elevator controller 20—either directly or indirectly.

In some embodiments, the control system 10 can be applied with appropriate interface to existing elevator controls to multi-elevator buildings or installations.

In some embodiments, the control system may not include the use of ICUDs 25 (See, FIGS. 1.*a*.3, 1.*b*.2, 1.*c*.2 and 1.*e*.2 for example). In some embodiments the use of ICUDs 25 provides desirable additional functionality that is not provided by the HUFDs 24. Examples of advantageous use of ICUDs 25 in control systems 10 are implementations having duplex or multiplex installations of elevators (2 or more than 2 elevators at a location). In some embodiments, the ICUDs 25 do not require connections through the flexible cable 31 of the elevator system although in some embodiments such connections may be utilized. ICUDs 25 may include one or more of the following smart features or functionalities; position, direction, car position sensor connection, on site alphanumeric programmable position name or number, (as well as detection of phone/tag recognition, social distance, passengers biometric data recognition (i.e. face recognition, etc.), body temperature, mask properly wearing, etc.), wireless communication with HUFDs 24 and/or smartphones or remote commands from client devices and can be combined with functions such as detect light on in the car and detect presence inside the car. In some embodiments ICUDs 25 may communicate wirelessly with HUFDs 24 to exchange data on position and direction of the car as well as other information. In some embodiments ICUDs 25 may also receive calls from user mobile devices 8 inside the elevator car 12. In some embodiments ICUDs 25 may utilize already existing elevator car 12 power sources (such as in the top of the elevator car 12) to maintain charge in an independent battery backup configured with the ICUD 25. In some embodiments the ICUD 25 may be adapted to be positioned anywhere inside or outside the car. The positioning may incorporate a contactless device to prevent closing of the doors when an object is detected in the door closing path to add increased safety operation. In some embodiments ICUD 25 might be connected directly in parallel to the pre-existing car operating panel positioned inside the car. In this case ICUD 25 may exchange data with HFUD's 24 or the client's device directly.

FIGS. 6 through 10 illustrate examples of a universal digital control system 10 according to one or more embodiments and may reflect embodiments referenced on each of the Figures or other embodiments. Shown is a control system 10 comprising an HUFD's 124, IUPS 142, ICUD 125, UICD 130, UID 131 and a linked application 144. The UICD 130 or UID 131 communicates with the existing elevator machinery 150 controller via link 148. When IUD 131 or IUCD 130 are omitted and incorporated into HUFD 124 and/or ICUD 125, line 148 may represent the connection to the pre-existing elevator system (it could be the controller or the car operating panel or the hall buttons). Communications path 146 illustrates the communications link enabling data flow between HUFD's 124, IUPS 142, ICUD 125, and UICD 130 or IUD 131 (also wired or wireless communications are considered). It should be noted that FIGS. 6-10 are illustrative only and do not particularly specify the sequence of data communications between components of the system. Instead, FIGS. 6-10 may be seen to indicate that the communications path 146 enables data flow generally through or to the various components in whatever order they are connected to the communications path 146 or if they are connected via a mesh or similar hierarchy. Communications path 146 may comprise both wired and wireless components.

FIGS. 6 through 10 illustrate examples of a universal digital control system 10 according to one or more embodiments. Shown is a control system 10 comprising HUFD's 124, IUPS 142, and UICD 130 or IUD 131, and a linked application 144. The UICD 130 communicates with the existing elevator machinery 150 controller via link 148. Communications path 146 illustrates the communications link enabling data flow between or among HUFDs 124, IUPS 142 and UICD 130 or IUD 131. Comparing the embodiments illustrated in FIGS. 6 through 10 may include only one HUFD 124.

In embodiments such as of FIGS. 6, 8, 9 and 10, the UID 131 functions primarily as an interface device communicating with the existing elevator machinery controller 150. In some embodiments such as shown in different figures an external UID 131 is not utilized. Instead, components of system 10 may interface with existing floor devices of the pre-existing elevator system and or with pre-existing car panel (and signals from the digital system 10 are conveyed to the existing elevator machinery 150 or elevator controller 20. Additionally, in some embodiments as shown in different figures, the UID 131 functionality may also be embedded into one or more HUFD 124 or ICUP 125 so that signals from the embedded UID may be transmitted directly from the embedded UID 131 to the elevator controller 20 (and/or to the call button circuits at respective floors and/or the elevator car control panel button circuits). In some such embodiments, the UID 131 functions to convert signals (from one or more HUFDs 124 or ICUP 125 intended for transmission to the existing elevator machinery 150 or elevator controller 20) to the proper format and/or pinout of the existing elevator machinery 150 or elevator controller 20.

In some embodiments one or more HUFDs 124 may embody a bulk of the intelligence of the system 10. One or more HUFD 124 may include UICD 130 or UID 131 and data may flow between that one or more HUFD 124 and elevator machinery 150 and/or elevator controller 20 via communications path 146 or other communications paths or systems. Drawings show both wired and wireless communication solutions.

Figure 5:
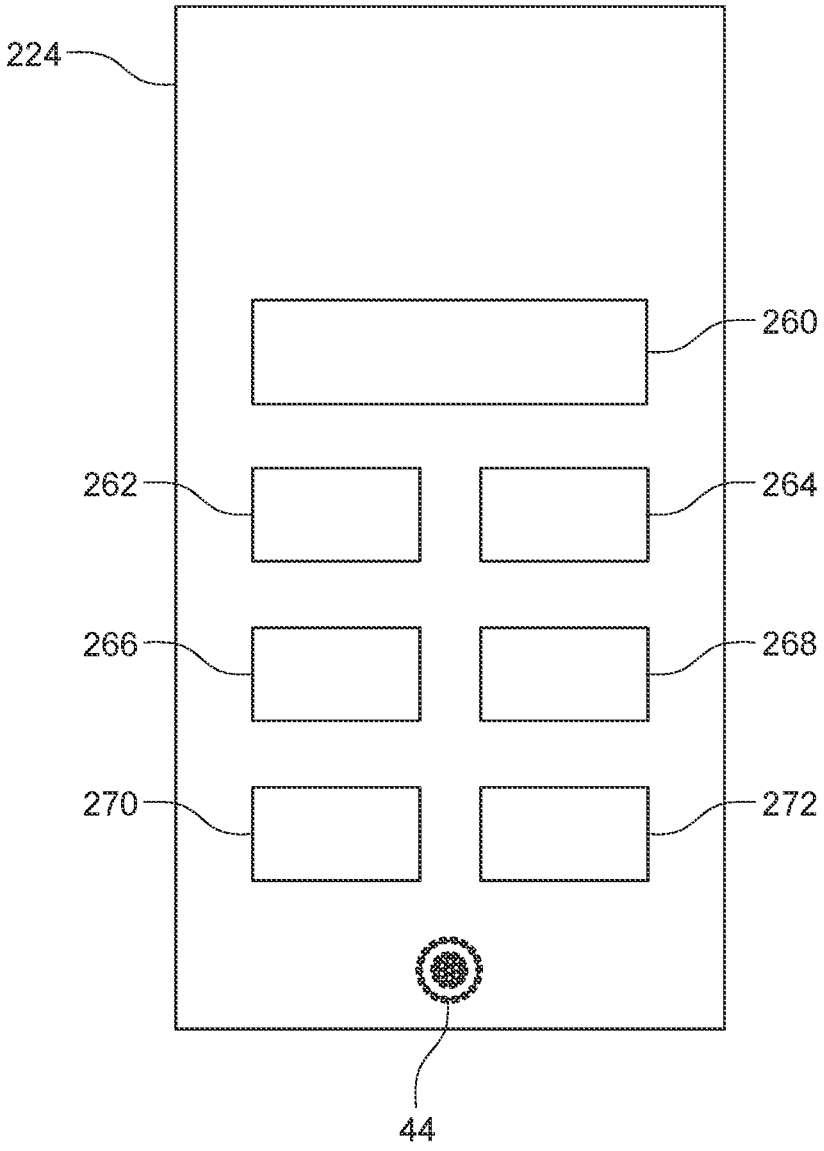
FIG. 5 illustrates an example of a universal device according to one or more embodiments.
Figure 6:
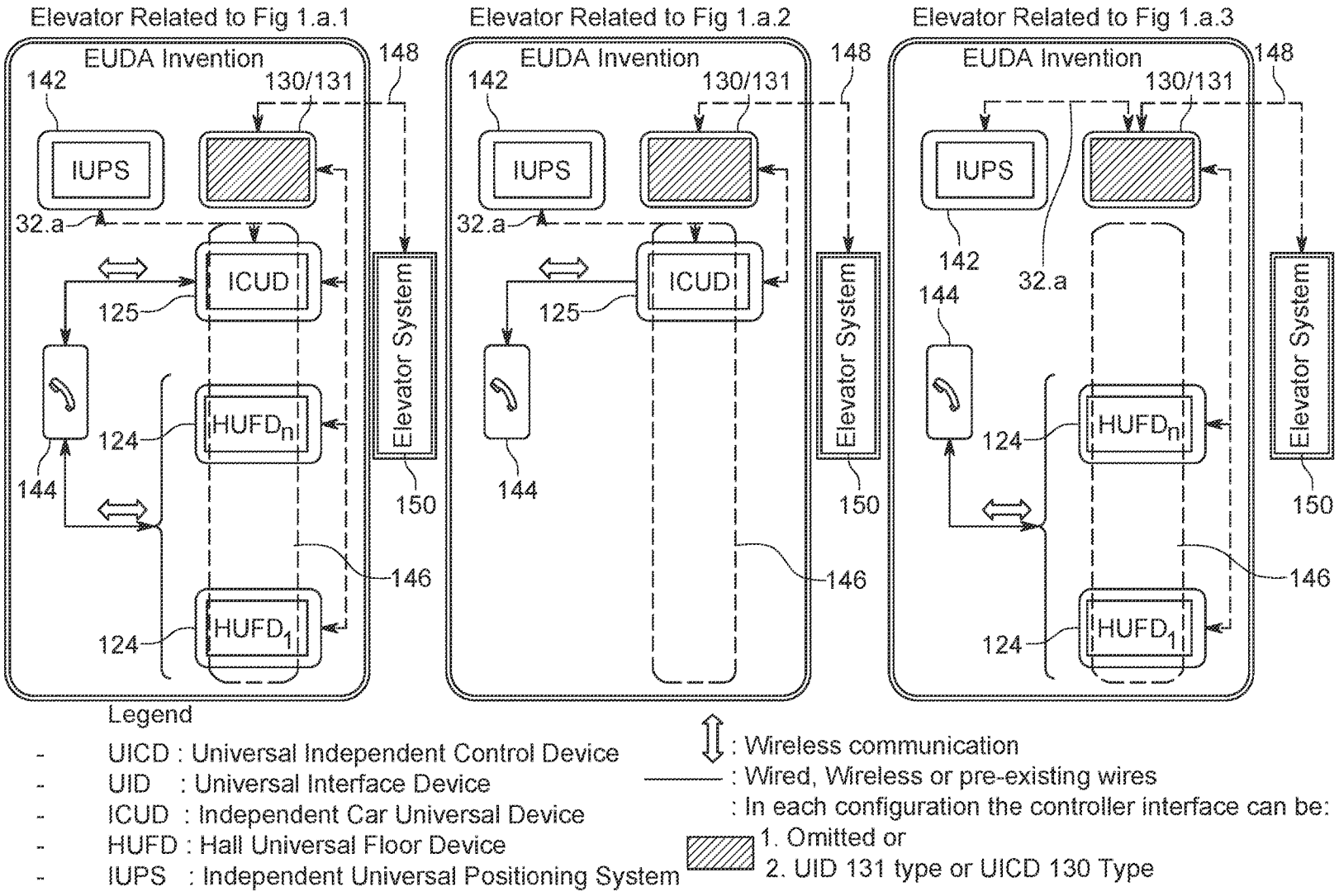
FIG. 6 illustrates examples of universal digital control systems according to one or more embodiments including as may relate in some embodiments to embodiments illustrated in FIGS. 1.*a*.1 to 1.*a*.3.
Figure 7:
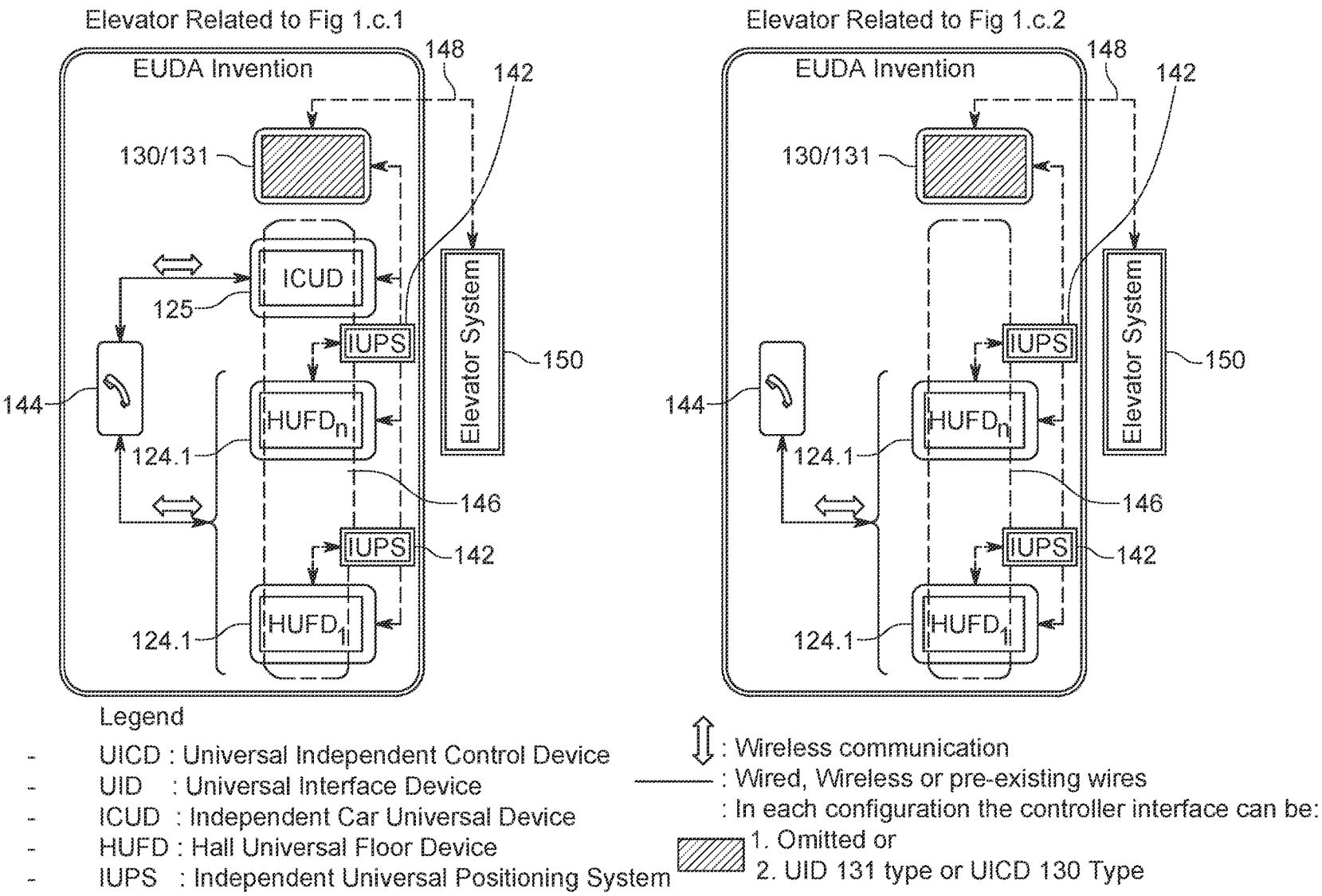
FIG. 7 illustrates examples of a universal digital control system according to one or more embodiments, including as may relate in some embodiments to embodiments illustrated in FIGS. 1.*c*.1 and 1.*c*.2.
Figure 8:
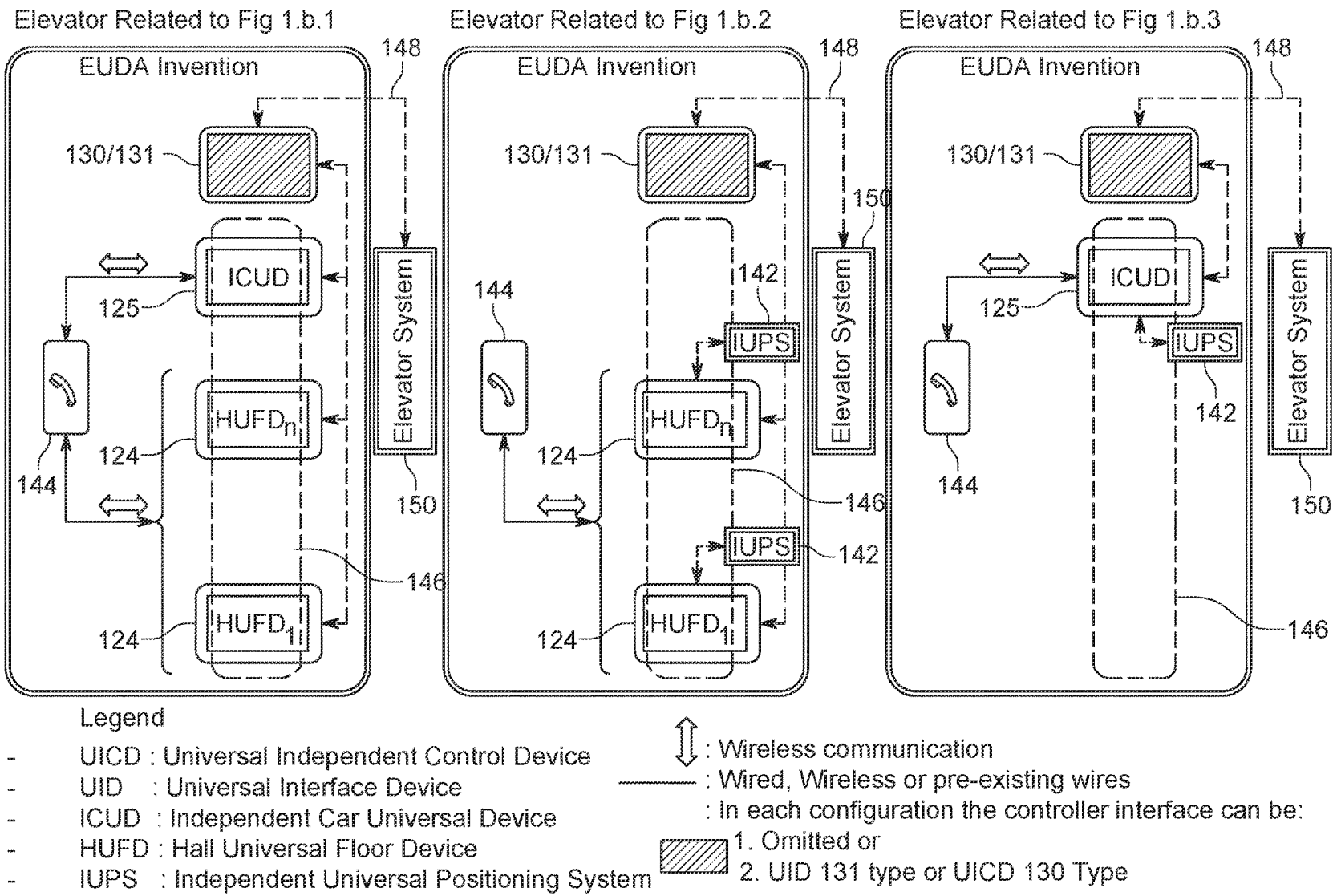
FIG. 8 illustrates examples of a universal digital control system according to one or more embodiments, including as may relate in some embodiments to embodiments illustrated in FIGS. 1.*b*.1 to 1.*b*.3.
Figure 9:
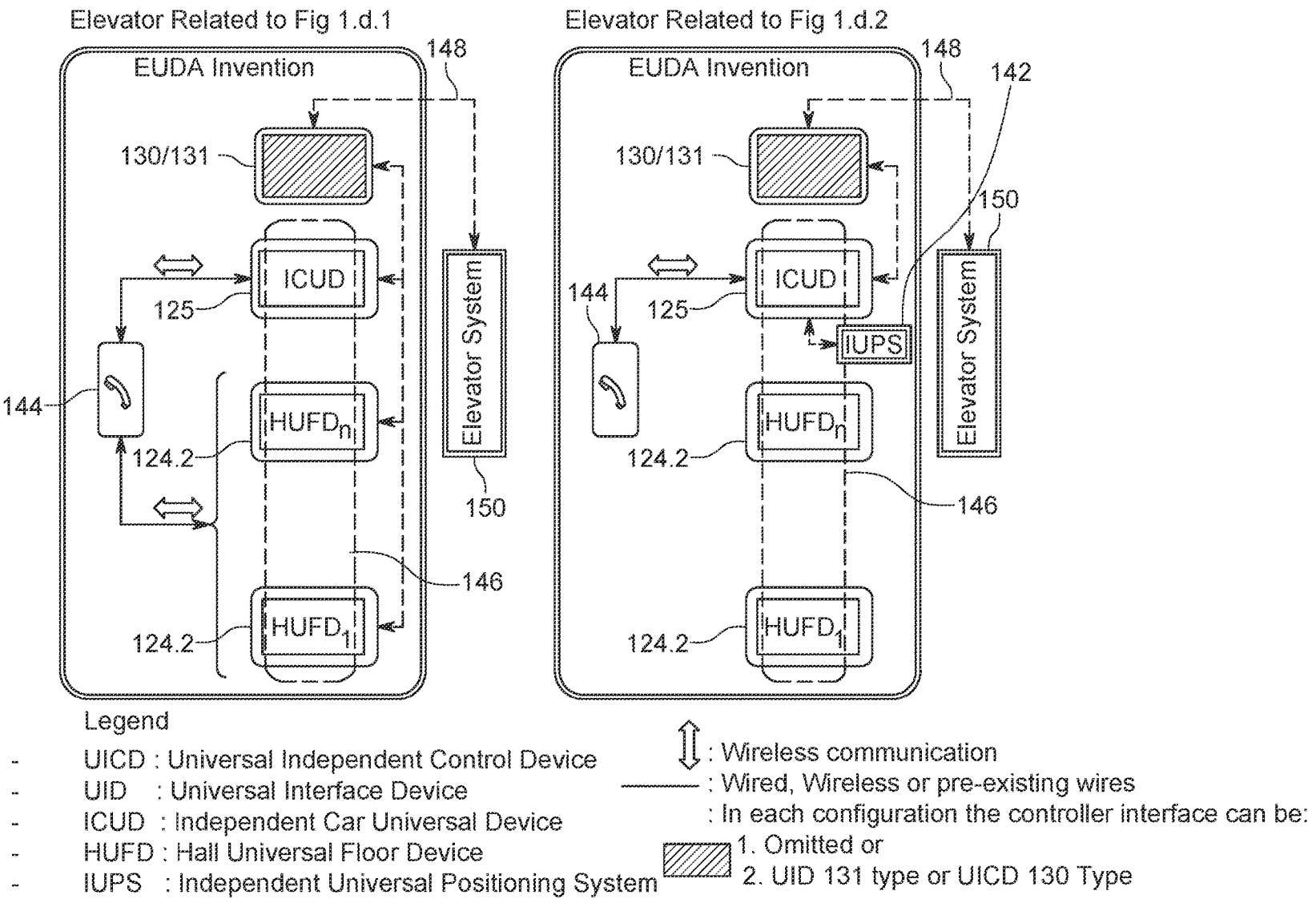
FIG. 9 illustrates examples of a universal digital control system according to one or more embodiments, including as may relate in some embodiments to embodiments illustrated in FIGS. 1.*d*.1 and 1.*d*.2.
Figure 10:
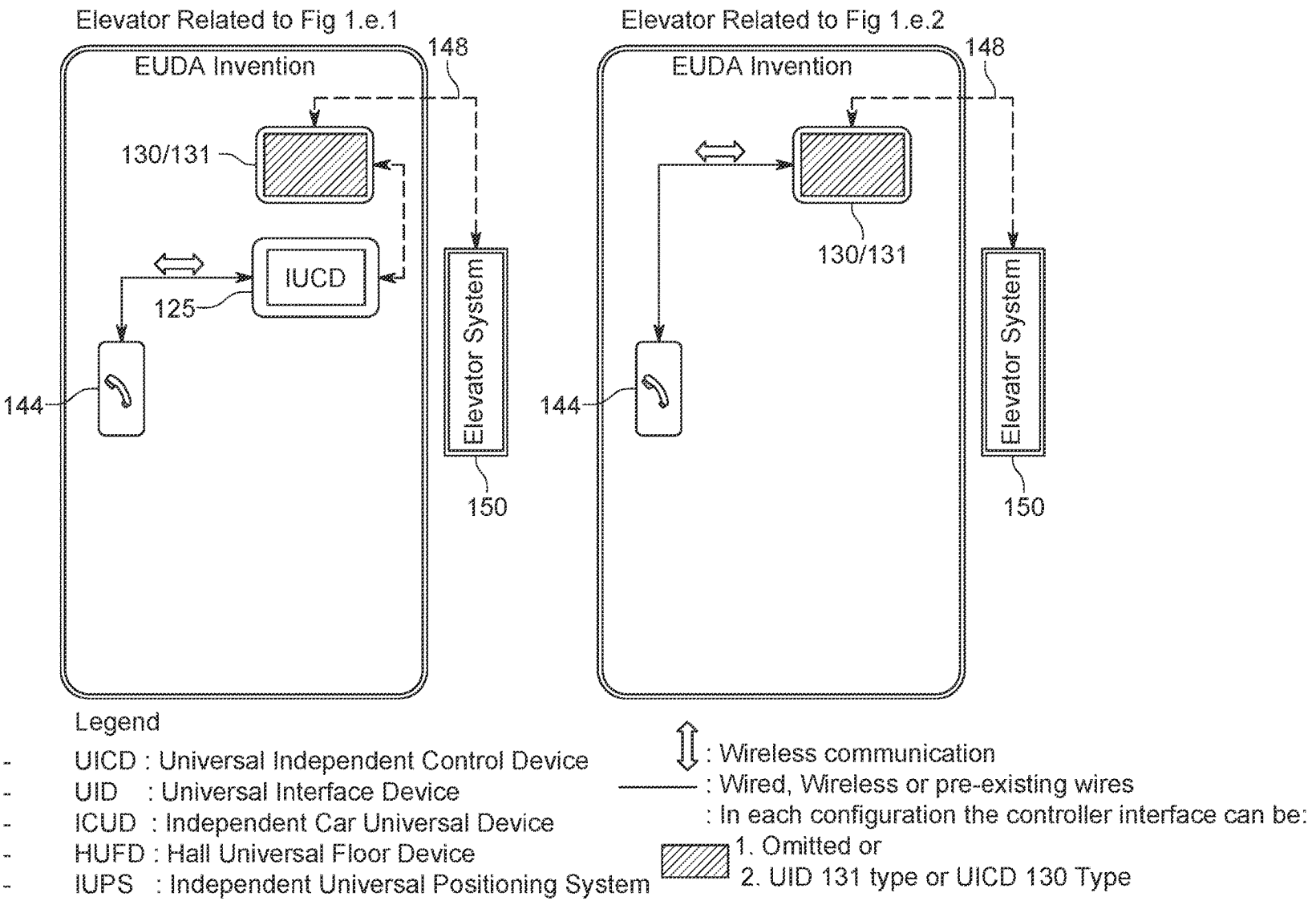
FIG. 10 illustrates examples of a universal digital control system according to one or more embodiments, including as may relate in some embodiments to embodiments illustrated in FIGS. 1.*e*.1 and 1.*e*.2.
Figure 11:
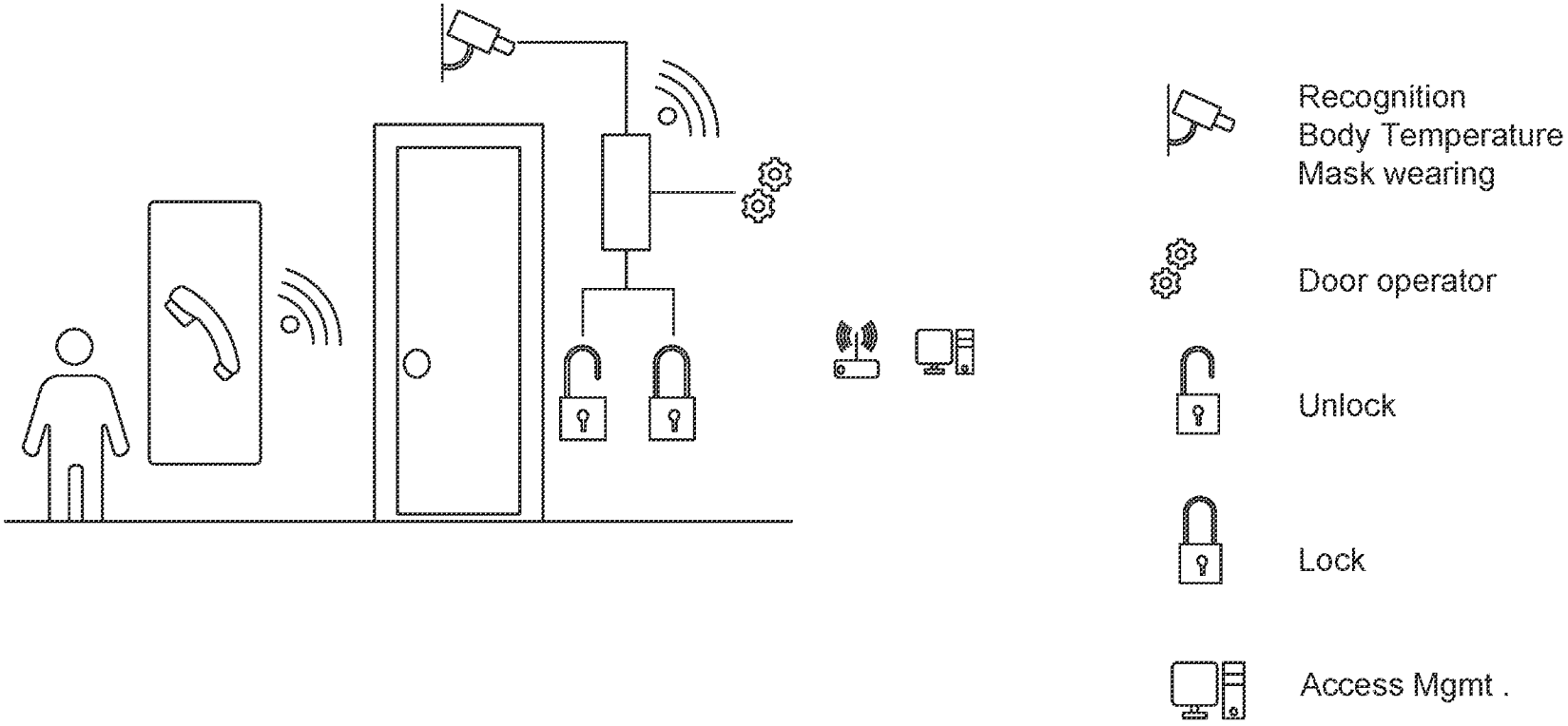
FIG. 11 illustrates an example of a universal digital control system applied to facilitate access control of one or more spaces.

FIG. 5 illustrates an example of a universal digital control system or components thereof according to one or more embodiments. Shown is an exemplary HUFD 224 and/or ICUD 125 in functional/instrumentality view. As also shown in FIG. 5, HUFD 224 also includes sensors 260 which may comprise any number of sensors and/or sensor types which may include, but be not limited to, cameras (both still and video), temperature sensors, proximity sensors, movement sensors, light sensors, microphones, antennas, laud-speakers as well as other sensors. Data from one or more of the sensors may be conveyed to processor 268 and/or to other components of HUFD 224 or control system 10. The processor 268 may analyze data from the one or more sensors and conduct a wide range of processes, such as detecting human presence, detecting other presence, detecting movement, detecting and analyzing the temperature of objects (including living beings), the speed of movement of objects, the proximity of objects, the number of separate objects, levels of light, changes in light, biometric characteristics. Processor 268 may also analyze or process data from other components of the system 10 as well as from other sources. Further functional/instrumentality components of HUFD 224 comprise communications with user module 262, communications with system module 264, display 266, data storage 270, and battery backup 272. The functionality of each or many of the components of HUFD 224 may be combined with that of other components of HUFD/ICUD 224. Among other things, the communications with user module 262 may assist with communications with users, including speech recognition, recognition of visual signals from user or from user phones, recognition of wireless and electronic signals and communications with users (such as via user mobile device 8). In some embodiments, the functionality of HUFD/ICUD 224 may serve to provide local communications with users, analysis of elevator door floor proximity spaces, security and alerting for issues in the elevator door floor proximity spaces, passenger biometric data recognition (i.e. face recognition, etc.), object recognition, temperature check and verification, movement detection analysis, signaling and alerting relating. In some embodiments, the HUFD/ICUD 224 handle all or virtually all the local decision making for the floor and then transmit signals to UID 131 or UICD 30 for signaling the elevator controller 20. In some embodiments, one or more HUFD/ICUD 224 may comprise UID 131, UICD 130 or other capability to communicate with elevator controller 20 (without the inclusion of a separate UID 131 or UICD 130 in the system). In this way, and by way of example, the HUFD/ICUD 224 can detect the approaching presence of a user "known" to the system or a potential user not yet "known" to the system. The HUFD/ICUD 224 can establish communications with the user's mobile phone, can recognize the user's face, can greet the user audially or visually, can suggest or call and elevator and a target destination for the user based on the system's analysis of the user's previous use of the system and communicate the same to the user via any, many or all of the communication system options, the HUFD/ICUD 224 can alert to a sensed temperature exceeding predefined limits and take consequential decisions or actions such as, for example, prohibiting the elevator doors from opening and thus prohibiting entry into the elevator or disembarking to a floor of the person manifesting the heightened temperature, refusing to "call" the elevator for the user manifesting the heightened temperature as well as alerting the user to the user's temperature, alerting the building of the user temperature, alerting other users or others in the proximity of the HUFD/ICUD 224, and can send a message to building mgmt. In some embodiments, the HUFD/ICUD 224 may process any requests by the user and transmit them, if approved by HUFD/ICUD 224 to the control system 10 to call an elevator or otherwise respond to the request. In some of these embodiments, then, the HUFD/ICUD 224 need not have broadband or even any connectivity to the internet, but by use of its own sensors and communications with the user (and, in some instances other devices in the control system 10) the HUFD/ICUD 224 can conduct virtually all decision making needed to process local user needs and system/building safety protocols and, upon HUFD/ICUD 224 approval of these, can transmit an elevator "call" signal to the control system 10. The HUFD/ICUD 224 can conduct any of the processing/actions described in this disclosure for an HUFD/ICUD 224 (as well as UICD 130 or UID 131).

FIGS. 1.*a*, 1.*b*., 1.*c*, 1.*d* and 1.*e* illustrate example of universal digital control systems 10 or components thereof according to one or more embodiments. Many components in FIG. 1.*a* are the same as shown in FIG. 1.*b*, 1.*c*, 1.*d*, 1.*e*. As already discussed, FIG. 1.*a*, however, shows IUPS 23 as a positioning system that can be located anywhere in hoistway 14 (and which may comprise a laser or encoders, etc.) and capable of determining the position of elevator car 12 with great precision. Data from IUPS 23 is shown communicated to UICD 30 via wireline 32*a* although wireless communications may also be used between IUPS 23 and UICD 30. As pointed out above, in certain embodiments, no separate UICD 30 or UID 31 is needed and the UICD 30 or UID 31 functionality is embodied in other components of the system 10, such as in one or more HUFD/ICUD 224. In some of such embodiments, data from IUPS 23 may be communicated to any or all of the other components of the system such as, in some cases, via a communications link 146 or other link.

Importantly, in some embodiments the control system 10 can leverage existing systems of the existing elevator. For example, in some embodiments, the control system 10 can collect information from the existing elevator vertical position system rather than utilizing an independent universal position system 23 or 123 and use the collected vertical position information in operation of the control system 10.

The control system in some embodiments may comprise a unique Independent Universal System 10 comprised of a HUFD 24 at each floor or only at some (or one) floor of those floors serviced by a particular elevator system. Some embodiments may comprise HUFDs 24 with embedded information permitting display of the elevator position and direction information independently from the elevator control system. In some embodiments, one or more HUFDs 24 may comprise a reader transmitter that connects with the user smartphone or similar devices. In some embodiments, a ICUD 25 may be connected wirelessly with one or more HUFDs 24 and may have a reader transmitter that connects with the user smartphone or similar devices. In some embodiments, the control system may comprise an IUPS 23 that enables a HUFD 24 to detect the position of the elevator car independent and free from any interference with the pre-existing or traditional elevator system. In some embodiments, the control system may comprise an IUPS 23 that enables a ICUD 25 to detect the position of the elevator car independent from and free any interference with the pre-existing or traditional elevator system. In some embodiments, the control system 10 may comprise only one electrical interface with the elevator system and that electrical interface may be from the UICD 30 or UID 31 to the elevator controller 20. In some embodiments, the control system 10 may enable command and supervisory function by the control system 10 over the otherwise existing elevator machinery. In some embodiments, a smartphone application in a mobile device 8 may receive data from the control system 10 and the data received is sourced only from the control system 10 without reference to data from the otherwise existing elevator control systems. In some embodiments, a smartphone application in a mobile device 8 may send data to the control system 10 to control operations of the elevator system via the control system 10 without accessing manual elevator call buttons or elevator internal control panel buttons.

The control system 10 may, in some embodiments, be modular with the various components readily identifying other installed control system 10 components (such as HUFDs 24, ICUDs 25, UICD 30 and other components) and in some embodiments providing essentially a plug and play variety of components. Further, various embodiments may provide different levels of sophistication in the capabilities and processing of the several components of the control system 10. Such modular embodiments, particularly, with varying levels of processing sophistication in various system components allows for a readily connected variety of components with component cost factors matched to the needed processing sophistication capabilities of the particular components of the system assembled to be installed.

For example, in some embodiments the HUFDs 24 serve relatively simple functionality of communicating with user mobile phones 8, ICUD 25 and the UICD 30, while the UICD 30 carries out tracking the elevator car 12 location data from IUPS 23, communication to elevator controller 20, formulation of signals back to HUFDs 24 and ICUD 25, and tracking and logging of elevator performance data.

For example, in some embodiments the UID 131 functions primarily as only an interface device communicating with the existing elevator machinery 150 while the intelligence (or control component) of the system 10 is embodied in one or more HUFDs 124 (with the one or more HUFDs 124 carrying out tracking the elevator car 12 location data from IUPS 123, communicating to the UID 131, communicating with the ICUD 125, communicating with other HUFDs 124, and tracking and logging elevator performance data). The logging can be everywhere included the smartphone of the users and info are downloaded when 8 is connected to the WI FI.

For example, in some embodiments each HUFD 24 may comprise relatively sophisticated processing capabilities providing processing intensive capabilities such as passenger biometric data recognition (i.e. face recognition, etc.) at each floor location, in other embodiments the ICUD 25 can perform the same relatively sophisticated processing capabilities providing processing intensive capabilities such passenger biometric data recognition (i.e. face recognition, etc.). In some of these embodiments the UID 131 may be relatively non-sophisticated and system 10 principal controls, control component functions, and data tracking and logging may be carried out by one or more of the relatively sophisticated HUFDs 24 (or ICUDs 25).

For example, in some embodiments one HUFD 24 (and/or ICUD 25) may comprise relatively sophisticated processing capabilities providing processing intensive capabilities such passenger biometric data recognition (i.e. face recognition, etc.) at one floor such as the main or ground floor. The additional HUFDs 24 on other floors may be relatively less sophisticated with the one HUFD 24 on the main or ground floor conducting principle system 10 controls, inter-component communications and data tracking and logging.

In some embodiments, the present invention may comprise a system wherein a device not attached to the elevator car controls operations of the system. For example, in some embodiments a device neither attached to a floor or the elevator car controls operation of the system. For example, in some embodiments the device which controls operations of the system may be associated with a vertical position sensing system or may be positioned elsewhere in relation to the elevator system.

In some embodiments, the communications from the elevator passenger (whether a service call from an individual floor or a target floor destination input—or other passenger command (e.g., stop, hold doors, close doors, etc.)) may be received directly at the ICUD 25 without being first received at a HUFD 24. In some such embodiments, inclusion of separate HUFD's 24 may not be needed. In some embodiments of this fashion, the system 10 may comprise an ICUD 25 comprising a control component in communication with a vertical position sensing system, the ICUD 25 configured to receive passenger service call requests, target floor destination inputs (and, in some instances, other passenger inputs), the ICUD 25 further in functional communication with the elevator controller and directing elevator car travel and service with the elevator controller responding to directions from the ICUD 25 and yet maintaining control over travel and safety operations of the elevator.

While the particulars of certain embodiments have been described in this specification, it should be understood that in certain embodiments any or all of the first or second communications systems may comprise wireless communications.

It should be understood that certain embodiments of the present invention may comprise an independent elevator control system to be used or installed in an elevator system wherein the first elevator system does not comprise all the components of a first elevator system as otherwise described herein. Further, it should be understood that certain embodiments of the present invention may comprise all or some of the components or aspect of the presently described independent elevator control system applied to a new build or rebuild elevator system wherein the components of the presently described independent elevator system comprise the only floor devices and/or the only elevator device and/or the only vertical position sensor system in the new build. By way of illustration, in an exemplary new build elevator system, the principal floor devices may comprise HUFD's, and/or the principal elevator car control panel device may comprise an ICUD, and the principal vertical position sensor system may comprise an IUPS. In some such embodiments, the new build elevator system may be configured without the use of floor devices other than the HUFD's, and/or the elevator control panel device may comprise substantially only an ICUD, and/or the new build elevator system may rely principally on the IUPS rather than a different system for vertical position sensing. Similarly, in a rebuild scenario, existing floor devices, elevator control panel components, and/or vertical positioning components may be disabled or removed and the rebuilt elevator system may be functionally configured using one or more of the HUFD's, ICUD and/or IUPS. In addition and in some instances as alternative embodiments various of the HUFD's, ICUD and/or IUPS may be substituted for first system (or otherwise existing) floor device, elevator control panels and/or vertical positioning system which substituted first system components may be disabled, removed, replaced or left intact while one or more of the HUFD's, ICUD, and/or IUPS components or functionality may be inserted into the existing elevator system.

In some embodiments a EUDA type controller functionality can be embodied in a new equipment elevator controller, termed in this case a EUDA enabled controller. In some embodiments a EUDA enabled controller can be installed in conjunction with a new elevator system and can be in functional communication with EUDA floor devices and EUDA elevator car device(s) via wireless connections and without physical wiring between the EUDA floor devices, the EUDA elevator car device(s) and the EUDA enabled controller. The EUDA enabled components can then control the elevator system while also providing all the other EUDA enabled features described in this application.

In some embodiments a EUDA enabled controller may be installed in an existing elevator system and communicate wirelessly with EUDA floor devices and EUDA car device(s) that, similarly, have been installed at the existing elevator system. The EUDA enabled components can then control the elevator system while also providing all the other EUDA enabled features described in this application.

In some embodiments, the EUDA system may deduce the number of passengers in a particular elevator car. The number of estimated passengers in the elevator car may then be used to estimate the weight of passengers or loading in the elevator car. This estimated weight can then be used by the EUDA system to guard for and/or implement safety features such as alarming for a weight overload situation and possibly taking appropriate action (such as not allowing the elevator doors to close or not allowing the elevator car to travel), or providing directions that some passengers should exit the car for weight or safety reasons, or other appropriate action. In some embodiments, the EUDA system may detect the presence of cargo, packages or other non-living objects in the elevator car and generate an estimated weight for such objects in the EUDA calculations for weight loading of the elevator car.

In some embodiments the EUDA system may use the number of mobile phones detected in the elevator car to estimate the number of passengers in the elevator car. In some embodiments the EUDA system may use sensors, such as cameras, heat sensors, or other sensors, to estimate the number of passengers in the elevator car. From the estimated number of elevator passengers in the elevator car, the EUDA system can calculate an estimated weight of the estimated total number of passengers (such as by using one or more preset weight values associated with each type of passenger detected in the elevator car).

In some embodiments the EUDA system or a health device/system as described herein may use the deduced number of passengers and/or estimated weight loading in the elevator car and accumulate the deduced loading data in operational databases for service, safety, maintenance and/or other reasons. Additionally, data relating to the accumulated weight loading and elevator weight load carried by the elevator may be communicated to systems outside the immediate elevator system.

In some embodiments the EUDA system can function to cause the elevator car, notwithstanding possible contrary operational protocols of the elevator system, to skip floors (i.e, not stop and open doors at one or more skipped floors) in circumstances wherein the EUDA system has determined that the elevator car is fully loaded (such as by reaching an assigned estimated weight of passengers or cargo) and that there are not passengers in the elevator car targeting to disembark the car at the skipped floor(s).

In some embodiments the EUDA system may optimize traffic patterns of the elevator car(s) based on the EUDA's knowledge of the location and destination requests of elevator users and at the floors and the passengers in the elevator car(s). In some embodiments, the EUDA system may further recognize the number of people waiting on one or more floors for elevator service and utilize this recognized number in the EUDA calculations to optimize elevator travel and traffic operations.

In some embodiments the EUDA system may serve to detect and provide indication and/or notification to a call center for service or rescue operations of an "Out of Service" or "Trapped Passenger" condition.

In some embodiments the EUDA system can recognize passengers (e.g., via phone ID, face recognition, or other) and ascertain whether the recognized passenger is boarding the appropriate elevator car targeted for the destination floor of that passenger (including, such as in a multi-car elevator system). Further, in some embodiments a EUDA system can identify and alert passengers if a passenger is disembarking the elevator car on an incorrect floor (as ascertained by the target floor requested by the particular passenger).

In some embodiments the EUDA system can enable recognition of voice commands such as to keep open or to close landing doors such as if there is a user whose hands are otherwise occupied, such as by holding parcels, a child, the leash of an animal, pushing a stroller, a wheel chair, or such. Once enabled, the EUDA can use recognized voice commands, in some cases in conjunction with recognition of the particular passenger (such as via recognition of a mobile phone, face recognition or other means), to provide passenger request input to the EUDA system for elevator travel or other operations.

In some embodiments, the EUDA system can sense conditions supporting triggering of an audible or inaudible alarm or a wireless alarm such as when a dangerous condition for a passenger is sensed. In some embodiments, the EUDA can recognize the presence of more than one passenger in the elevator car and then can implement special sensing and analysis protocols to provide protection or alarms for one or more passengers (such protocols may include monitoring passenger behavior to detect threats or other unacceptable behavior by one of the passengers). In some embodiments, the EUDA system may also activate voice recognition when more than one passenger is detected in the elevator car so that the voice recognition can recognize and alert if a passenger verbally calls out or requests help or assistance or provides other recognizable verbal cues for the EUDA system.

In some embodiments, the EUDA system can modify the existing elevator controller protocol systems, such as an existing "down collective", "up collective", "full collective", "single action push button (SAPB)", or other protocol, and thereby have the elevator system operate according to more sophisticated or customized protocols as recommended by the EUDA software or elevator management. In some embodiments, the protocols implemented by the EUDA system may change by time of day, day of week, or according to other sensed conditions relating to the elevator system.

Aspects of the present invention comprise a method of upgrading an existing elevator system wherein the existing elevator system comprises an elevator car and a first elevator controller that processes signals from first passenger input devices and directs travel of the elevator car in accordance with at least one elevator command protocol and wherein the method of upgrading the existing elevator system comprises installing an independent control device in functional communication with the existing elevator system. Further aspects of the present invention may comprise one or more methods of this paragraph (or other paragraphs) wherein the independent control device receives signals from a second set of passenger input devices (which, in some embodiments, may receive or send and receive communications from passenger mobile electronic devices). Further aspects of the present invention may comprise one or more methods of this paragraph (or other paragraphs) wherein the independent control device processes the signals from the second set of passenger input devices and sends command signals to the first elevator controller such that the first elevator controller causes the elevator car to travel vertically to floors in accordance with the command signals sent by the independent control device. Further aspects of the present invention may comprise one or more methods of this paragraph (or other paragraphs) wherein the first elevator controller maintains safety and operational control of the elevator car notwithstanding causing the elevator car to travel in accordance with the command signals sent by the independent control device. Further aspects of the present invention may comprise one or more methods of this paragraph (or other paragraphs) wherein the independent control device may direct the first elevator controller to cause the elevator car to travel according to an elevator command protocol different from a protocol followed by the first elevator controller without the intervention of the independent control device. Further aspects of the present invention may comprise one or more methods of this paragraph (or other paragraphs) wherein the independent control device may direct the first elevator controller to cause the elevator car to travel according to an elevator command protocol different from a command protocol to which the first elevator controller is configured prior to the installation of the independent control device in functional communication with the first elevator controller. Further aspects of the present invention may comprise one or more methods of this paragraph (or other paragraphs) wherein the independent control device may direct the first elevator controller to cause the elevator car to travel in accord with one or more of the protocols of President, SAPB, Down Collective, Up Collective, and or Full Collective. Further aspects of the present invention may comprise one or more methods of this paragraph (or other paragraphs) wherein the In some embodiments, aspects of the present invention comprise methods of upgrading or customizing the operating command protocols of an existing elevator system by implementing an independent control device that receives passenger requests and/or target floor designations, processes those requests or designations using an operating command protocol different from a protocol the existing elevator system is configured to implement without the intervention of the independent control device, and issuing elevator travel commands to the existing elevator system according to the upgraded or customized operating command protocols while allowing the existing elevator system to continue to operate according to its existing safety and operational protocols. Such upgraded or customized operating command protocols may include President, SAPB, Down Collective, Up Collective, and or Full Collective or other known or customized protocols. The independent control device may be relatively easily modified by changing or upgrading the software of the control device. Such changing or upgrading may be accomplished by a variety of known techniques such as remote upgrading via the internet or other communications system or local upgrading of software. Since the independent control device does not affect the existing safety and operational systems and protocols of the existing elevator system, changes or upgrades to the software of the independent control device may be made without affecting the mechanical and safety operations of the existing elevator system.

For clarity, in some embodiments, the components of the independent system may be described as an add-on system (or a system "piggy backed") onto the existing elevator control system. Thus, users may use either the independent system or the existing system to input calls or instructions. If a passenger places a service call at a first system floor device, the call made via the existing floor device buttons will go directly to the existing (first) elevator controller and the elevator response to that service call be governed by the protocols of that (first) elevator controller, while passenger service calls placed through the EUDA system will go to the independent control device and the elevator travel itinerary may be controlled by the protocols or other software of the independent elevator controller—while safety and operational controls are still handled by the existing elevator controller. Additionally, if a passenger places a floor destination designation via the first system car device, the floor destination designation placed via the existing car device buttons will go directly to the existing (first) elevator controller and the elevator response to that floor destination designation may be governed by the protocols of the (first) elevator controller. Alternatively, if a passenger places a floor destination designation via the second (independent) system (such as via communication with a second (independent) car device and/or a second (independent) floor device and/or another second (independent) device such as by signals from the passenger mobile device to the second (independent) component(s), the elevator travel itinerary may be controlled by the protocols or other software of the independent elevator controller—while safety and operational controls are still handled by the existing elevator controller. In some such embodiments then, the elevator operates according to the protocols of the first elevator system when passenger signals are received via the first elevator system input devices and operates according to the protocols of the independent second elevator (or EUDA) system when passenger signals are received via the independent second (or EUDA) system.

In some embodiments, aspects of the present invention may comprise a system wherein an independent component, in some instances termed as "independent health device may be attached to an elevator system, may be configured to be in data communications with a vertical position sensing system and may monitor and store performance data of the elevator car. In some embodiments the independent health device may be in functional communications with the existing elevator system so as to receive (and possibly store) data representing each call for service received by the elevator system, each target floor destination received by the system, each target floor destination received by the system in association with a particular service call, and performance data relating to the elevator system. The performance data may comprise one or more of: each call for elevator service received by the system, each target floor destination, each target floor destination in association with a call for elevator service, the actual time of travel of the elevator for each service run, the time and date of each operation of the elevator system, the speed of each movement of the elevator car, the accumulated travel time of the elevator car, the accumulated travel distance of the elevator car, any alarms generated by any component of the elevator system, the identity and travel history of each elevator passenger in the elevator, the accuracy of the stopping position of the elevator car at each floor, the operation of the elevator doors, the on or off condition of the lights in the elevator. The independent health device may analyze aspects of the performance data, including analyzing in light of predetermined performance thresholds and store the analyzation results. The independent health device may communicate performance data and/or analyzation results with certain devices of the first elevator system and/or with devices not a part of the first elevator system. In some embodiments, the independent health device may be in functional communications with or comprise an independent vertical position system independent of the first or existing elevator vertical positioning sensing system. In some embodiments, the independent health device may serve a role of monitoring elevator system performance, but not controlling elevator operations. In some embodiments, the independent health device may serve as an elevator monitoring system independent of otherwise existing elevator systems. In some embodiments the independent health device may generate and/or communicate alarms to components outside the basic functional components of the elevator system when certain analytic computations of the independent car device indicate that aspects of the performance data have exceeded or subceeded predetermined performance thresholds. In some embodiments such alarms are automatically communicated to components outside the basic functional components of the elevator system. In some embodiments such alarms may serve to halt or minimize operation of the elevator system. In some embodiments the independent health device may generate and communicate periodic performance reports of the elevator system.

Although the invention has been described with reference to specific embodiments, it will be understood by those skilled in the art that various changes can be made without departing from the spirit or scope of the invention. Accordingly, the disclosure of embodiments is intended to be illustrative of the scope of the invention and is not intended to be limiting. It is intended that the scope of the invention shall be limited only to the extent required by the appended claims. To one of ordinary skill in the art, it will be readily apparent that the systems and methods discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

What is claimed is:

1. An independent system for upgrading an existing elevator system in a structure, wherein the existing elevator system comprises:

a plurality of first floor devices with separate first floor devices positioned respectively on individual floors of the structure and each first floor device configured to receive elevator passenger call inputs;

a first elevator car control input panel at least one first elevator vertical position sensing system;

a first elevator controller which receives signals corresponding to passenger call inputs from the first floor devices; which receives signals corresponding to passenger floor destination inputs from the car control input panel; which receives elevator car position data from at least one first elevator vertical position sensing system; and which controls travel and safety operations of the elevator; and a first communication system providing communications between the plurality of first floor devices and the first elevator controller;

the independent system configured to receive signals corresponding to passenger elevator call inputs and passenger floor designation inputs and comprising:

a plurality of second floor devices with separate ones of the second floor devices positioned respectively on individual floors of the structure and configured to receive elevator passenger call inputs;

a second elevator vertical position sensing system;

an independent control component in functional communication with the first elevator controller, the second floor devices and the second elevator vertical position sensing system and configured to:

process received signals corresponding to elevator passenger call inputs from the second floor devices, passenger floor destination inputs, and elevator vertical position data from the second elevator vertical position sensing system, and generate an elevator car travel itinerary based on the processed signals; and generate command signals for transmission to the first elevator controller to cause the first elevator controller to provide elevator car service conforming to the generated elevator car travel itinerary; and dispatch the generated command signals to be communicated to the first elevator controller; and wherein the independent system is configured with the existing elevator system such that the first elevator controller can direct travel of the first elevator car according to signals from the existing elevator devices and also direct travel according to signals from the independent system devices.

2. The independent system of claim 1, wherein the first elevator controller maintains direct control over travel and safety operations of the elevator car but also directs the operations of the elevator car in response to the command signals delivered to the first elevator controller from the independent control component.

3. The independent system of claim 2, wherein at least one of the second floor devices is configured to receive passenger service call requests from an elevator passenger mobile phone.

4. The independent system of claim 2, further comprising:

a second elevator car device attached to the elevator car and configured to receive passenger floor destination inputs from an elevator passenger mobile phone and wherein the independent control component processes signals received by the second elevator car device in generating an elevator car travel itinerary.

5. The independent system of claim 4, further comprising:

a second communications system that provides functional signal communications between each of the second floor devices, the second elevator car device, the second vertical position sensing system, and the independent control component without utilizing the first communications system.

6. The independent system of claim 5, wherein the second communications system provides functional signal communications between the second elevator car vertical position sensing system and the independent control component without utilizing the first communications system.

7. The independent system of claim 6, wherein the second communications system comprises a wireline disposed in the elevator hoistway and in functional communication with each of the second floor devices.

8. The independent system of claim 2, wherein at least one second floor device comprises an independent control component.

9. The independent system of claim 4, wherein the independent control component is comprised in a device other than one of the second floor devices or the second car device.

10. The independent system of claim 5, wherein the independent system determines the vertical position of the elevator car by triangulation between the second elevator car device and at least one second floor device.

11. The independent system of claim 5, wherein the independent control component is comprised in a device other than one of the second floor devices or the second elevator car device.

12. A method of upgrading a first existing elevator system having a plurality of first floor devices, a first elevator control device, a first vertical position sensing system, and a first communications system providing transmission of signals between the plurality of first floor devices, the first vertical position sensing system, and the first elevator control device, the method comprising:

installing a second system at the existing elevator system, the second system comprising a plurality of second floor devices, a second elevator car device, a second vertical position sensing system, and a second communication system providing transmission of signals between the plurality of second floor devices, the second elevator car and the second elevator vertical position sensing system;

connecting the second system to the first system such that the first system maintains direct control over travel and safety operations of the elevator car using data from the first vertical position sensing system and the second system inputs elevator travel directions to the first elevator control device in response to receiving elevator user system calls and floor destination signals at second system devices and in response to processing data from the second vertical position sensing system; and such that the first system directs elevator travel under at least the directions from the second system.

13. The method of claim 12, wherein the second system determines the vertical position of the elevator car by triangulation between the second elevator car device and one or more of the second floor devices.

14. The method of claim 12, wherein after the second system is connected to the first system, the first elevator control device can receive signals from the first floor devices and the first elevator control device and direct travel of the elevator car in response to signals from the first system devices, and the first elevator control device can also receive signals from the second system and direct travel of the elevator car in response to signals from the second system.

15. The method of claim 12, wherein after the second system is connected to the first system, the second communications system provides functional signal communications between each of the second floor devices, the second elevator car device and the second vertical position sensing system without utilizing the first communications system.

16. The method of claim 15, wherein the second floor devices and the second elevator car device are configured to receive user inputs via touchless systems.

17. The method of claim 15, wherein:

the second system further comprises an independent control component in functional communications with the second floor devices, the second elevator car device via the second communications system; and the independent control component processes signals corresponding to elevator passenger call inputs received at the second floor devices and signals corresponding to passenger floor destination inputs received via the second communications system and generates an elevator car travel itinerary incorporating the results of such processing of signals and issues elevator command signals which are communicated to the elevator controller to cause the elevator controller to provide elevator car service conforming to the generated elevator car travel itinerary.

* * * * *